US011330366B2

(12) United States Patent
Pedersen et al.

(10) Patent No.: US 11,330,366 B2
(45) Date of Patent: May 10, 2022

(54) PORTABLE DEVICE COMPRISING A DIRECTIONAL SYSTEM

(71) Applicant: Oticon A/S, Smørum (DK)

(72) Inventors: Michael Syskind Pedersen, Smørum (DK); Carsten Scheel, Smørum (DK); Martin Bergmann, Smørum (DK); Henrik Bay, Smørum (DK); Morten Pedersen, Smørum (DK); Bent Krogsgaard, Smørum (DK); Jacob Mikkelsen, Smørum (DK); Stefan Gram, Smørum (DK); Jan M. De Haan, Smørum (DK); Andreas Thelander Bertelsen, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 16/855,232

(22) Filed: Apr. 22, 2020

(65) Prior Publication Data

US 2021/0337306 A1 Oct. 28, 2021

(51) Int. Cl.
*H04R 25/00* (2006.01)
*H04R 1/40* (2006.01)

(52) U.S. Cl.
CPC ..... *H04R 1/406* (2013.01); *H04R 25/554* (2013.01); *H04R 2201/403* (2013.01)

(58) Field of Classification Search
CPC combination set(s) only.
See application file for complete search history.

(56) References Cited

U.S. PATENT DOCUMENTS 7,912,237 B2 3/2011 Fischer
8,391,522 B2 3/2013 Biundo Lotito et al.
(Continued)

FOREIGN PATENT DOCUMENTS

EP 3253075 A1 12/2017
EP 3588981 A1 1/2020

*Primary Examiner* — Phylesha Dabney
(74) *Attorney, Agent, or Firm* — Birch, Stewart, Kolasch & Birch, LLP

(57) ABSTRACT

A sound capture device configured to be worn by a person and/or to be located on a surface is configured to pick up target sound from a target sound source s. The sound capture device comprises a) an input unit providing a multitude of electric input signals, each comprising a target signal component and a noise signal component; b) a directional noise reduction system comprising a beamformer unit coupled to said multitude of input signals and configured to provide an estimate of the target sound s. The beamformer unit comprises b1) target maintaining, reference beamformer providing a current reference signal; and b2) a target cancelling beamformer providing a current target cancelling sign. The directional noise reduction system is configured to operate in at least two modes in dependence of a mode control signal, 1) in a directional mode and 2) in a non-directional, omni-directional mode. The sound capture device further comprises c) antenna and transceiver circuitry for establishing an audio link to another device, and to transmit said estimate of the target sound s to said another device, and d) a mode controller for determining said mode control signal in dependence of said current reference signal and said current target cancelling signal. A method of operating a sound capture device is further disclosed.

22 Claims, 12 Drawing Sheets

(56) References Cited

U.S. PATENT DOCUMENTS

| | | | | |
|---|---|---|---|---|
| 10,932,066 | B2 * | 2/2021 | Pedersen | H04R 25/652 |
| 2017/0256272 | A1 | 9/2017 | Kamkar Parsi et al. | |
| 2019/0014422 | A1 * | 1/2019 | Lunner | H04R 25/402 |
| 2019/0253813 | A1 * | 8/2019 | Pedersen | H04R 25/405 |

* cited by examiner

PORTABLE DEVICE COMPRISING A DIRECTIONAL SYSTEM

SUMMARY

The present disclosure relates to a sound capture device configured to pick up sound from an environment and to transmit processed sound to a hearing device, e.g. a hearing aid, or to another device or system. The sound capture device (and the hearing device) may be configured to be worn by a hearing device user or another person. In different situations, e.g.

a) the sound capture device may be worn by a user of the hearing device and configured to pick up the hearing user's own voice and to transmit it to another device, e.g. a phone or any other communication device or system, or b) the sound capture device may be configured to be worn by a person in communication with the user of the hearing device and to transmit the voice of the person to the hearing device, or c) the sound capture device may be left on a carrier, e.g. a table, and configured to pick up sound from its environment, e.g. sound from a number of persons (e.g. two or more), and to transmit the sound to the hearing device, and/or to another device or system, e.g. a communication device.

The present disclosure includes a scheme for adjusting signal processing in a sound capture device based on estimated directional performance of microphones of the sound capture device, e.g. a scheme for changing a signal processing mode, e.g. to change between a directional mode and an omni-directional mode of operation, of the sound capture device.

The present disclosure also relates to detection of a user's own voice in a sound capture device, such as a hearing device, e.g. a hearing aid, based on estimated directional performance of microphones of the sound capture device.

U.S. Pat. No. 8,391,522B2 suggests to use an accelerometer to change the processing of an external microphone array. U.S. Pat. No. 7,912,237B2 suggests to use an orientation sensor to change between omni-directional and directional processing of an external microphone array.

A Sound Capture Device:

In an aspect of the present application, a sound capture device configured to be worn by a person and/or to be located on a surface, e.g. a table, is provided by the present disclosure. The sound capture device is configured to pick up target sound from a target sound source s. The sound capture device may comprise an input unit comprising a multitude of input transducers $IT_m$, m=1, 2, . . . , M, M being larger than or equal to two, each input transducer being configured to pick up a sound from the environment of the sound capture device and to provide corresponding electric input signals, each electric input signal $IN_m$, m=1, . . . , M, comprising a target signal component and a noise signal component;

a housing wherein said multitude of input transducers are located, and which may comprise a preferred direction;

a directional noise reduction system for providing an estimate of the target sound s, the directional noise reduction system comprising a beamformer unit operationally coupled to said multitude of input transducers $IT_m$, m=1, . . . , M. The beamformer unit may comprise a target maintaining, reference beamformer configured to leave signal components from a fixed target direction un-attenuated or less attenuated relative to signal components from other directions, and providing a current reference signal; and a target cancelling beamformer configured to attenuate signal components from said target direction, whereas signal components from other directions are attenuated less relative to signal components from said target direction, and providing a current target cancelling signal.

The directional noise reduction system may be configured to operate in at least two modes in dependence of a mode control signal, a directional mode wherein said estimate of the target sound s is based on target signal components from said fixed target direction, and a non-directional, omni-directional mode, wherein said estimate of the target sound s is based on target signal components from all directions.

The sound capture device may further comprise antenna and transceiver circuitry for establishing an audio link to another device, and the sound capture device may be configured to transmit said estimate of the target sound s to said another device.

The sound capture unit may further comprise, a mode controller for determining said mode control signal in dependence of said current reference signal and said current target cancelling signal.

Thereby an improved flexibility of use of a sound capture device may be provided.

The fixed target direction of the target maintain beamformer may coincide with the preferred direction of the housing of the sound capture device (or be known or estimated in advance of the use of the sound capture device). The multitude of input transducers may comprise a microphone array. Preferably the target direction is in the end fire direction of the microphone array. That is the direction parallel to the microphone array. A microphone direction may be defined by a direction through the centers of the microphones. The microphone array may be a linear array, wherein the microphones (two or more) are located on a straight line (the microphone direction).

In an embodiment the own voice beamformer is calibrated to a preferred placement of the sound capture device on the person, e.g. so that the preferred direction of the housing points towards the person's mouth. The calibration routine may take place in a special calibration mode. Or the calibration may take place during use, e.g. while own voice is detected.

The target maintaining beamformer may be a substantially omni-directional beamformer (cf. e.g. FIG. 2A). The target maintaining beamformer may have a frequency dependent attenuation (cf. e.g. FIG. 2D).

A maximum difference between the target maintaining and the target cancelling beamformers reflects that the voice of the persons wearing the sound capture device is present (or that the microphone direction coincides with a direction towards a current talker, e.g. when the sound capture device is located on a surface near the current talker).

The directional noise reduction system may be configured to switch between an omni-directional mode and a directional mode in dependence of the mode control signal.

At least one of the input transducers may be a microphone. A majority, or all of the input transducers may be microphones. The multitude of input transducers may be constituted by or comprise two microphones. The multitude of input transducers may comprise a microphone array. The multitude of input transducers may comprise MEMS microphones.

The sound capture device may comprise a filter bank. The filter bank may be configured to allow processing in the sound capture device to be performed in the filter bank domain (frequency domain), by providing a time domain input signal in a number frequency sub-bands, e.g. as a number K of frequency bins (k−1, . . . , K) in successive time frames l, each frequency bin being defined by respective frequency and time frame indices (k, l). The input unit of the sound capture device may e.g. comprise a multitude of M analysis filter banks, each being coupled to a different one of the M input transducers, and configured to provide each of the M electric input signals in a frequency sub-band/time-frequency representation (k, l).

The magnitude, or otherwise processed versions, of the respective current reference signal and the current target cancelling signal may be averaged across time to provide respective smoothed reference and target-cancelling measures. The magnitude (or magnitude squared) of the current reference signal(ref(k,l)) and said current target cancelling signal (TC(k,l)), respectively, may be provided by respective magnitude (or magnitude squared) operations (cf. |ref|, $(|ref|^2)$ and |TC|, $(|TC|^2)$ in FIG. 3). 'Otherwise processed versions of the respective current reference signal and the current target cancelling signal' may e.g. include a) a multiplication of the (possibly complex) values of the (complex conjugate of the) current reference signal with the current target cancelling signal (ref*TC) and b) the magnitude squared of the current target cancelling signal $(|TC|^2)$, respectively (cf e.g. FIG. 4).

The sound capture device may comprise a voice activity detector. The sound capture device may be configured to provide that the averaging only takes place, in time frames when the user's voice is detected by the voice activity detector. The voice may be detected by use of a voice activity detector, e.g. a modulation-based voice activity detector. The voice activity detector may be configured to estimate a voice presence probability (or as a binary value) in separate frequency sub-bands (e.g. in each frequency bin). The smoothed magnitudes of the reference beamformer (cf. 'OMNI-BF') and the target voice cancelling beamformer (cf. TC-BF) may be converted to the logarithmic domain (cf. units 'log' in FIG. 3).

The sound capture device may comprise a combination processor configured to compare the current reference signal and the current target cancelling signal, or processed versions thereof, in different frequency sub-bands, and to provide respective frequency sub-band comparison signals.

The sound capture device may comprise a decision controller configured to provide a resulting mode control signal indicative of an appropriate mode of operation of the directional noise reduction system in dependence of said frequency sub-band comparison signals. The difference found in separate frequency sub-bands (cf. SUM-unit '+' in FIG. 3, or DIV-unit '÷' in FIG. 4) are combined onto a joint decision across frequency (cf. block 'Decision' in FIG. 3, 4). The decision controller may e.g. be implemented by logic processing, e.g. as a weighted sum, or by logistic regression, or by a neural network. The weights may be estimated based on supervised learning. Alternatively, the combination function may be tuned manually.

The decision controller may be configured to provide said resulting mode control signal in dependence of a weighted sum of individual sub-band comparison signals. When the resulting mode control signal assumes a first (e.g. relatively large) value indicative of a first (relatively large) resulting difference between the current reference signal and said current target cancelling signal, or processed versions thereof, over frequency, it indicates that the benefit of directional noise reduction is high, and the directional noise reduction system should be switched to (or maintained in) the directional mode. Otherwise, if the resulting mode control signal assumes a second (e.g. relatively small) value indicative of a (second) resulting difference being relatively small (e.g. smaller than 3 dB or smaller than 6 dB or smaller than 9 dB), the potential benefit of directional noise reduction is limited, and the directional noise reduction system should be switched to (or maintained in) the omni-directional mode. The first resulting difference is assumed to be larger than the second resulting difference. The directional mode may be adaptive (e.g. adaptive in its noise reduction) or fixed. The mode control signal may be binary (e.g. 0 or 1). The mode control signal may be continuous (e.g. assume values in the interval [0; 1]) and the directional noise reduction system be adapted to provide be a smooth transition between the different directional modes in dependence of the mode control signal.

The directional noise reduction system may be adapted to be in a directional mode when the mode control signal indicates a relatively large difference over frequency between the current reference signal and the current target cancelling signal, or processed versions thereof, and to be in an omni-directional mode when the mode control signal indicates a relatively small difference over frequency between said current reference signal and the current target cancelling signal, or processed versions thereof. The directional noise reduction system may be adapted to be in an omni-directional mode when the mode control signal is smaller than a first threshold value. The directional noise reduction system may be adapted to be in a directional mode when the mode control signal is larger than a second threshold value. The directional noise reduction system may be adapted to be in a mode between an omni-directional mode and a directional mode when the mode control signal assumes values between the first and second threshold values.

The sound capture device may be constituted by or comprise a microphone device. The sound capture device may e.g. be constituted by a dedicated wireless microphone device. The sound capture device may e.g. be constituted by or form part of a hearing device, e.g. a hearing aid, or a headset.

In a further aspect, a sound capture device, e.g. a hearing device, such as a hearing aid, configured to be worn by a user is provided. The sound capture device comprises an input unit comprising a multitude of input transducers $IT_m$, m=1, 2, . . . , M, M being larger than or equal to two, each input transducer being configured to pick up a sound from the environment of the sound capture device and configured to provide corresponding electric input signals, each electric input signal $IN_m$, m=1, . . . , M, comprising a target signal from a target signal source and a noise signal from one or more noise signal sources;

an own voice detector configured to provide an own voice control signal indicative of whether or not, or with what probability, a given electric input signal, or a processed version thereof, originates from the voice of said user.

The own voice detector may comprise a beamformer unit operationally coupled to said multitude of input transducers $IT_m$, m=1, . . . , M, the beamformer unit comprising target maintaining, reference beamformer configured to leave signal components from a fixed target direction un-attenuated or less attenuated relative to signal components from other directions, and providing a current reference signal; and a target cancelling beamformer configured to attenuate signal components from said target direction, whereas signal components from other directions are attenuated less relative to signal components from said target direction, and providing a current target cancelling signal;

wherein said fixed target direction is a direction from the sound capture device towards the user's mouth and said target signal is the user's own voice; and a controller for determining said own voice control signal in dependence of said current reference signal and said current target cancelling signal.

The controller may be configured to determine the own voice control signal in dependence of a comparison of the current reference signal and said current target cancelling signal.

The controller may be configured to determine the own voice control signal in dependence of the magnitude of the reference and target cancelling beamformers.

The target cancelling beamformer (i.e. here, the own voice cancelling beamformer), e.g. the beamformer weights, may be updated when own voice is detected. Thereby the performance of the own voice cancelling beamformer (which may be distance- (due to near field) as well as tilt-dependent) may be improved.

The sound capture device, e.g. a hearing device, may comprise a keyword detector for detecting one of a limited number of keywords in one said multitude of electric input signals or a processed version thereof, wherein said keyword detector is activated in dependence of said own voice control signal. The sound capture device may comprise a voice control interface allowing functionality of the sound capture device, e.g. a hearing device, such as a hearing aid, to be controlled. The keyword detector may be connected to the voice control interface. The keyword detector may be configured to detect a wake-word for activating the voice-control interface. The keyword detector may be connected to the own-voice detector.

The sound capture device comprises an input unit for providing an electric input signal representing sound. The input unit comprises an input transducer, e.g. a microphone, for converting an input sound to an electric input signal.

The sound capture device may comprise a directional microphone system adapted to spatially filter sounds from the environment, and thereby enhance a target acoustic source among a multitude of acoustic sources in the local environment of the user wearing the sound capture device. The directional system may be adapted to detect (such as adaptively detect) from which direction a particular part of the microphone signal originates. This can be achieved in various different ways as e.g. described in the prior art. In sound capture devices, e.g. hearing aids, a microphone array beamformer is often used for spatially attenuating background noise sources. Many beamformer variants can be found in literature, e.g. a Linearly-Constrained Minimum-Variance (LCMV) beamformer. A special variant thereof, the minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

The sound capture device may comprise antenna and transceiver circuitry (e.g. a wireless transceiver or receiver) for wirelessly transmitting and/or receiving a direct electric input signal to/from another device, e.g. to/from a communication device, or another sound capture device, e.g. a hearing aid. The direct electric input signal may represent or comprise an audio signal and/or a control signal and/or an information signal. The communication between the hearing aid and the other device may be in the base band (audio frequency range, e.g. between 0 and 20 kHz). Preferably, communication between the sound capture device and the other device is based on some sort of modulation at frequencies above 100 kHz. Preferably, frequencies used to establish a communication link between the sound capture device and the other device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). The wireless link may be based on a standardized or proprietary technology. The wireless link may be based on Bluetooth technology (e.g. Bluetooth Low-Energy technology).

The sound capture device may have a maximum outer dimension of the order of 0.15 m (e.g. a handheld mobile telephone). The sound capture device may have a maximum outer dimension of the order of 0.08 m (e.g. a headset). The sound capture device may have a maximum outer dimension of the order of 0.04 m (e.g. a hearing aid or hearing instrument).

The sound capture device may be or form part of a portable (i.e. configured to be wearable) device, e.g. a device comprising a local energy source, e.g. a battery, e.g. a rechargeable battery. The sound capture device may e.g. be a low weight, easily wearable, device, e.g. having a total weight less than 100 g.

The sound capture device may comprise a forward or signal path between an input unit (e.g. an input transducer, such as a microphone or a microphone system and/or direct electric input (e.g. a wireless receiver)) and an output unit, e.g. an output transducer and/or a transmitter. The signal processor may be located in the forward path. The signal processor may be adapted to provide a frequency dependent gain according to a user's particular needs. The sound capture device may comprise an analysis path comprising functional components for analyzing the input signal (e.g. determining a level, a modulation, a type of signal, an acoustic feedback estimate, etc.). Some or all signal processing of the analysis path and/or the signal path may be conducted in the frequency domain. Some or all signal processing of the analysis path and/or the signal path may be conducted in the time domain.

The sound capture device may comprise an analogue-to-digital (AD) converter to digitize an analogue input (e.g. from an input transducer, such as a microphone) with a predefined sampling rate, e.g. 20 kHz. The sound capture device may comprise a digital-to-analogue (DA) converter to convert a digital signal to an analogue output signal, e.g. for being presented to a user via an output transducer.

The sound capture device, e.g. the input unit, and/or the antenna and transceiver circuitry comprise(s) a TF-conversion unit for providing a time-frequency representation of an input signal. The time-frequency representation may comprise an array or map of corresponding complex or real values of the signal in question in a particular time and frequency range. The TF conversion unit may comprise a filter bank for filtering a (time varying) input signal and providing a number of (time varying) output signals each comprising a distinct frequency range of the input signal. The TF conversion unit may comprise a Fourier transformation unit for converting a time variant input signal to a (time variant) signal in the (time-)frequency domain. The frequency range considered by the sound capture device from a minimum frequency $f_{max}$ to a maximum frequency $f_{max}$ may comprise a part of the typical human audible frequency range from 20 Hz to 20 kHz, e.g. a part of the range from 20 Hz to 12 kHz. Typically, a sample rate $f_s$ is larger than or equal to twice the maximum frequency $f_{max}$, $f_s \geq 2f_{max}$. A signal of the forward and/or analysis path of the sound capture device may be split into a number NI of frequency bands (e.g. of uniform width), where NI is e.g. larger than 5, such as larger than 10, such as larger than 50, such as larger than 100, such as larger than 500, at least some of which are processed individually. The sound capture device may be adapted to process a signal of the forward and/or analysis path in a number NP of different frequency channels (NP≤NI). The frequency channels may be uniform or non-uniform in width (e.g. increasing in width with frequency), overlapping or non-overlapping.

The sound capture device may be configured to operate in different modes, e.g. a normal mode and one or more specific modes, e.g. selectable by a user, or automatically selectable. A mode of operation may be optimized to a specific acoustic situation or environment. A mode of operation may comprise a directional mode and a non-directional (e.g. omni-directional) mode of operation of the microphone system. A mode of operation may include a low-power mode, where functionality of the sound capture device is reduced (e.g. to save power), e.g. to disable wireless communication, and/or to disable specific features of the sound capture device.

The sound capture device may comprise a number of detectors configured to provide status signals relating to a current physical environment of the sound capture device (e.g. the current acoustic environment), and/or to a current state of the user wearing the sound capture device, and/or to a current state or mode of operation of the sound capture device. Alternatively or additionally, one or more detectors may form part of an external device in communication (e.g. wirelessly) with the sound capture device. An external device may e.g. comprise another sound capture device, a remote control, and audio delivery device, a telephone (e.g. a smartphone), an external sensor, a sound capture device, etc.

One or more of the number of detectors may operate on the full band signal (time domain). One or more of the number of detectors may operate on band split signals ((time-) frequency domain), e.g. in a limited number of frequency bands.

The number of detectors may comprise a level detector for estimating a current level of a signal of the forward path. The detector may be configured to decide whether the current level of a signal of the forward path is above or below a given (L-)threshold value. The level detector operates on the full band signal (time domain). The level detector operates on band split signals ((time-) frequency domain).

The sound capture device may comprise a voice activity detector (VAD) for estimating whether or not (or with what probability) an input signal comprises a voice signal (at a given point in time). A voice signal may in the present context be taken to include a speech signal from a human being. It may also include other forms of utterances generated by the human speech system (e.g. singing). The voice activity detector unit may be adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). The voice activity detector may be adapted to detect as a VOICE also the user's own voice. Alternatively, the voice activity detector may be adapted to exclude a user's own voice from the detection of a VOICE.

The sound capture device may comprise an own voice detector for estimating whether or not (or with what probability) a given input sound (e.g. a voice, e.g. speech) originates from the voice of the user of the system. A microphone system of the sound capture device may be adapted to be able to differentiate between a user's own voice and another person's voice and possibly from NON-voice sounds.

The number of detectors may comprise a movement detector, e.g. an acceleration sensor. The movement detector may be configured to detect movement of the user's facial muscles and/or bones, e.g. due to speech or chewing (e.g. jaw movement) and to provide a detector signal indicative thereof. The movement detector may be configured to detect whether the device in question (e.g. a sound capture device or a hearing device) is being moved or is lying still. An acceleration sensor may be configured to detect an orientation of (e.g. an angle with respect to) the device relative to the force of gravity.

The sound capture device may comprise a classification unit configured to classify the current situation based on input signals from (at least some of) the detectors, and possibly other inputs as well. In the present context 'a current situation' may be taken to be defined by one or more of a) the physical environment (e.g. including the current electromagnetic environment, e.g. the occurrence of electromagnetic signals (e.g. comprising audio and/or control signals) intended or not intended for reception by the sound capture device, or other properties of the current environment than acoustic);

b) the current acoustic situation (input level, feedback, etc.);

c) the current mode or state of the user (movement, temperature, cognitive load, etc.); and d) the current mode or state of the sound capture device (program selected, time elapsed since last user interaction, etc.) and/or of another device in communication with the sound capture device.

The classification unit may be based on or comprise a neural network, e.g. a trained neural network.

The sound capture device may be constituted by a hearing device, e.g. a hearing aid or a headset.

A Hearing Device, e.g. a Hearing Aid:

The sound capture device may comprise or be constituted by a hearing device, e.g. a hearing aid.

The features of embodiments of the sound capture as described above and below, e.g. in the detailed description of embodiments, in the drawings or in the claims are intended to be combined with features of the hearing device, e.g. hearing aid, and vice versa, where appropriate.

The hearing aid may be adapted to provide a frequency dependent gain and/or a level dependent compression and/or a transposition (with or without frequency compression) of one or more frequency ranges to one or more other frequency ranges, e.g. to compensate for a hearing impairment of a user. The hearing aid may comprise a signal processor for enhancing the input signals and providing a processed output signal.

The hearing aid may comprise an output unit for providing a stimulus perceived by the user as an acoustic signal based on a processed electric signal. The output unit may comprise a number of electrodes of a cochlear implant (e.g. for a CI type hearing aid) or a vibrator of a bone conducting hearing aid. The output unit may comprise an output transducer. The output transducer may comprise a receiver (loudspeaker) for providing the stimulus as an acoustic signal to the user (e.g. in an acoustic (air conduction based) hearing aid). The output transducer may comprise a vibrator for providing the stimulus as mechanical vibration of a skull bone to the user (e.g. in a bone-attached or bone-anchored hearing aid).

The hearing aid may further comprise other relevant functionality for the application in question, e.g. compression, feedback control, etc.

The hearing aid may comprise a hearing instrument, e.g. a hearing instrument adapted for being located at the ear or fully or partially in the ear canal of a user, e.g. a headset, an earphone, an ear protection device or a combination thereof. The hearing assistance system may comprise a speakerphone (comprising a number of input transducers and a number of output transducers, e.g. for use in an audio conference situation), e.g. comprising a beamformer filtering unit, e.g. providing multiple beamforming capabilities.

Use:

In an aspect, use of a sound capture device as described above, in the 'detailed description of embodiments' and in the claims, is moreover provided. Use may be provided in a system comprising audio distribution. Use may be provided in a system comprising one or more hearing aids (e.g. hearing instruments), headsets, ear phones, active ear protection systems, etc., e.g. in handsfree telephone systems, teleconferencing systems (e.g. including a speakerphone), etc.

A Method:

In an aspect, a method of operating a sound capture device configured to be worn by a person and/or to be located on a surface, e.g. a table, is furthermore provided by the present application. The sound capture device may be configured to pick up target sound from a target sound source s. The method may comprise one or more, such as a majority or all of the following steps providing a multitude M of electric input signals, each electric input signal $IN_m$, m=1, . . . , M, comprising a target signal component and a noise signal component;

providing an estimate of the target sound s, providing a target maintaining, reference beamformer configured to attenuate signal components from other directions than a fixed target direction, whereas signal components from the fixed target direction are left un-attenuated or are attenuated less relative to signal components from said other directions, and providing a reference signal in dependence of said multitude M of electric input signals; and providing a target cancelling beamformer configured to attenuate signal components from said target direction, whereas signal components from other directions are attenuated less relative to signal components from said target direction, and providing a target cancelling signal in dependence of said multitude M of electric input signals;

providing at least two modes in dependence of a mode control signal, a directional mode wherein said estimate of the target sound s is based on target signal components from said fixed target direction, and a non-directional, omni-directional mode, wherein said estimate of the target sound s is based on target signal components from all directions;

establishing an audio link to another device, and transmitting said estimate of the target sound s to said another device, and determining said mode control signal in dependence of said reference signal and said target cancelling signal.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

A Computer Readable Medium or Data Carrier:

In an aspect, a tangible computer-readable medium (a data carrier) storing a computer program comprising program code means (instructions) for causing a data processing system (a computer) to perform (carry out) at least some (such as a majority or all) of the (steps of the) method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Other storage media include storage in DNA (e.g. in synthesized DNA strands). Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a sound capture device as described above, in the 'detailed description of embodiments', and in the claims, AND another device is moreover provided.

The hearing system may be adapted to establish a communication link between the sound capture device and the 'another device' to provide that information (e.g. control and/or status signals, and/or audio signals) can be exchanged or forwarded from one to the other.

The sound capture device may comprise or form part of a remote control device, a smartphone, or other portable electronic device having sound capture and communication capability, e.g. a wireless microphone unit.

The 'another device' may be a hearing device, e.g. a hearing aid. The hearing device may be constituted by or comprise an air-conduction type hearing aid, a bone-conduction type hearing aid, a cochlear implant type hearing aid, or a combination thereof.

The hearing system may be adapted to provide that the sound capture device transmits the estimate of the target sound s to the 'another device'.

Definitions

In the present context, a hearing aid, e.g. a hearing instrument, refers to a device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing aid may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing aid may comprise a single unit or several units communicating (e.g. acoustically, electrically or optically) with each other. The loudspeaker may be arranged in a housing together with other components of the hearing aid, or may be an external unit in itself (possibly in combination with a flexible guiding element, e.g. a dome-like element).

More generally, a hearing aid comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing aids, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing aid and/or for storing information (e.g. processed information, e.g. provided by the signal processing circuit), e.g. for use in connection with an interface to a user and/or an interface to a programming device. In some hearing aids, the output unit may comprise an output transducer, such as e.g. a loudspeaker for providing an air-borne acoustic signal or a vibrator for providing a structure-borne or liquid-borne acoustic signal. In some hearing aids, the output unit may comprise one or more output electrodes for providing electric signals (e.g. to a multi-electrode array) for electrically stimulating the cochlear nerve (cochlear implant type hearing aid).

In some hearing aids, the vibrator may be adapted to provide a structure-borne acoustic signal transcutaneously or percutaneously to the skull bone. In some hearing aids, the vibrator may be implanted in the middle ear and/or in the inner ear. In some hearing aids, the vibrator may be adapted to provide a structure-borne acoustic signal to a middle-ear bone and/or to the cochlea. In some hearing aids, the vibrator may be adapted to provide a liquid-borne acoustic signal to the cochlear liquid, e.g. through the oval window. In some hearing aids, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A h hearing aid may be adapted to a particular user's needs, e.g. a hearing impairment. A configurable signal processing circuit of the hearing aid may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing aid via an interface to a programming device (fitting system), and used by a processing algorithm executed by the configurable signal processing circuit of the hearing aid.

A 'hearing system' refers to a system comprising one or two hearing aids, and a 'binaural hearing system' refers to a system comprising two hearing aids and being adapted to cooperatively provide audible signals to both of the user's ears. Hearing systems or binaural hearing systems may further comprise one or more 'auxiliary devices', which communicate with the hearing aid(s) and affect and/or benefit from the function of the hearing aid(s). Such auxiliary devices may include at least one of a remote control, a remote microphone, an audio gateway device, an entertainment device, e.g. a music player, a wireless communication device, e.g. a mobile phone (such as a smartphone) or a tablet or another device, e.g. comprising a graphical interface. Hearing aids, hearing systems or binaural hearing systems may e.g. be used for compensating for a hearing-impaired person's loss of hearing capability, augmenting or protecting a normal-hearing person's hearing capability and/or conveying electronic audio signals to a person. Hearing aids or hearing systems may e.g. form part of or interact with public-address systems, active ear protection systems, handsfree telephone systems, car audio systems, entertainment (e.g. TV, music playing or karaoke) systems, teleconferencing systems, classroom amplification systems, etc.

Embodiments of the disclosure may e.g. be useful in applications such as an auxiliary device in connection with a hearing aid or hearing aid system.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1B:
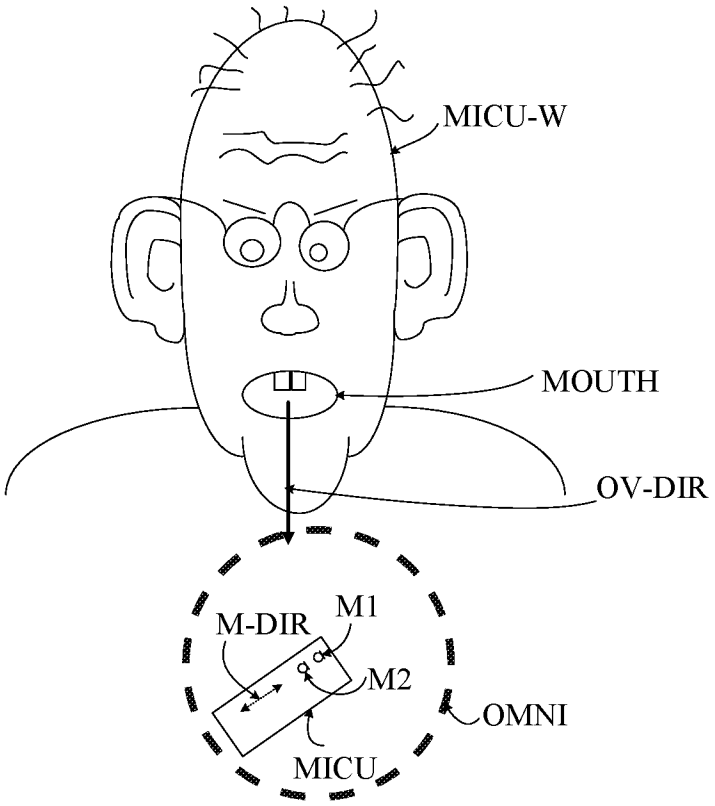
FIG. 1B shows a sound capture device positioned in a sub-optimal way, where the microphone axis points away from the wearer's mouth.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include micro-electronic-mechanical systems (MEMS), integrated circuits (e.g. application specific), microprocessors, microcontrollers, digital signal processors (DSPs), field programmable gate arrays (FPGAs), programmable logic devices (PLDs), gated logic, discrete hardware circuits, printed circuit boards (PCB) (e.g. flexible PCBs), and other suitable hardware configured to perform the various functionality described throughout this disclosure, e.g. sensors, e.g. for sensing and/or registering physical properties of the environment, the device, the user, etc. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of audio communication, in particular to a sound capture device, e.g. to hearing aid(s). In an aspect, it relates to interaction of a hearing aid (hearing instrument) with an external (auxiliary) device. The auxiliary device may take the form of a (e.g. wireless) sound capture device, e.g. comprising a microphone array, configured to communicate with the hearing aid. The wireless sound capture device may e.g. be adapted for being worn by a person, e.g. the user of a hearing aid or another person, and/or be adapted for being positioned at a location where sound of interest to the hearing aid user can be picked up, e.g. at a support structure, such as a table or a shelf. The wireless sound capture device may comprise at least two microphones and be configured to apply directional processing in order to enhance a desired sound signal picked up by microphones of the sound capture device. Directional processing is desirable, when the sound of interest always is impinging from the same desired direction. When a sound capture device is attached to a person, the person's voice is (assumed to be) of interest. Given that the sound capture device is correctly mounted, the microphone array (e.g. a linear array) always points towards the person's mouth. Hereby directional processing can be applied in order to enhance the person's own voice while background noise is attenuated.

The sound capture device may thus be able to catch the sound of interest and to transmit the captured sound directly e.g. to a hearing instrument user. Hereby typically a better signal to noise ratio is obtained compared to the sound picked up directly by the hearing instrument microphones.

Figure 1A:
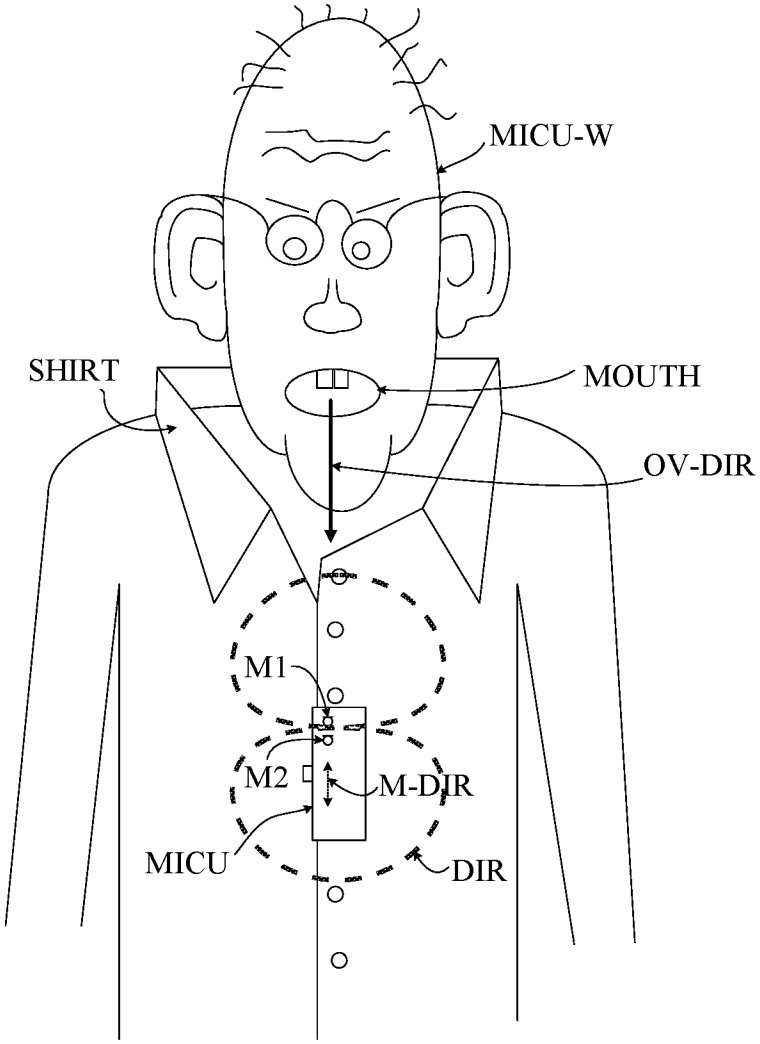
FIG. 1A shows a sound capture unit located in an ideal position attached to a shirt of a person and configured to pick up the voice of the wearer.
Figure 1C:
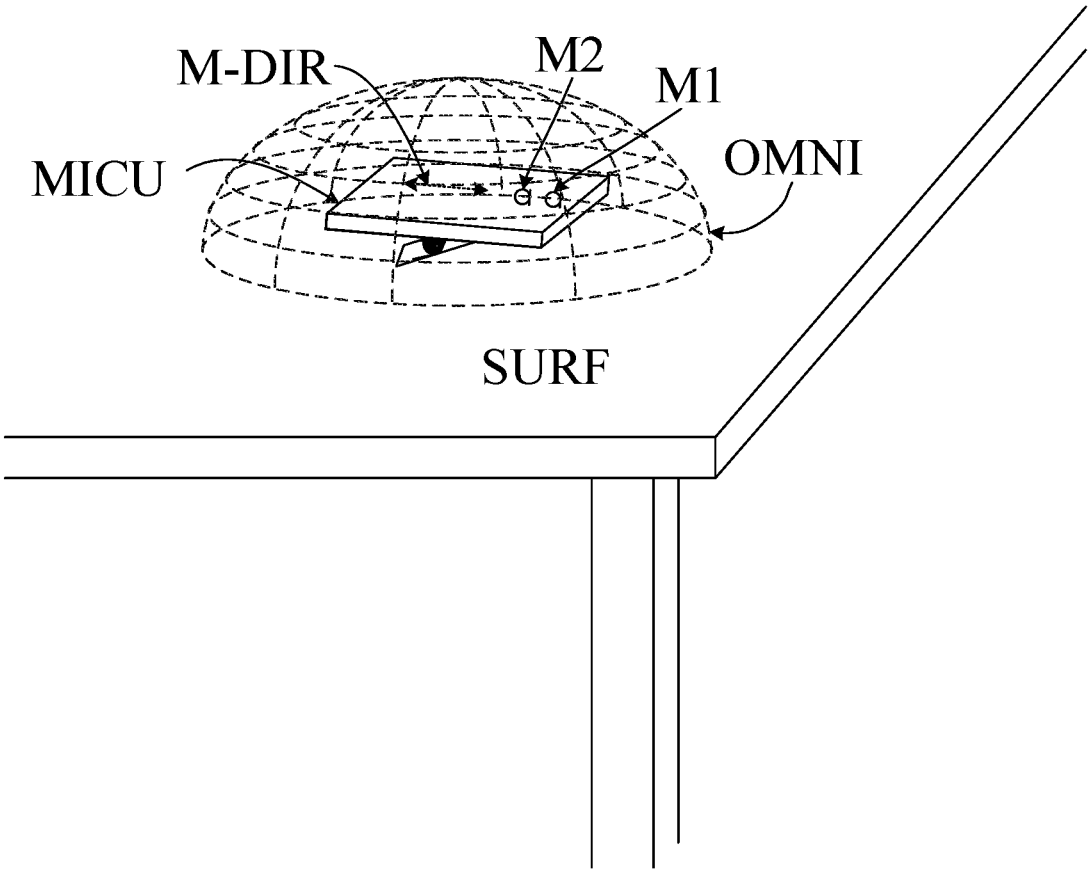
FIG. 1C shows the sound capture device used as a table microphone.

The sound capture device may however not always be used to pick up the voice of a single talker. Sometimes the sound capture device may be placed at a table in order to pick up the sound of any person located around the table. In this situation, an omni-directional response of the microphone may be more desirable than a directional response. Different sound capture device use cases are illustrated in FIG. 1A, 1B, 1C. The sound capture device, e.g. a microphone unit (MICU), comprises a housing wherein two microphones (M1, M2) are located. The two microphones define a microphone direction (M-DIR). The microphone direction is (in the embodiment of FIG. 1A-1C) parallel to a longitudinal ('preferred') direction defined by the housing. The microphone direction may define a target direction. The target direction of a target maintaining beamformer may be defined relative to the microphone direction or to the preferred direction of the housing of the sound capture device.

FIG. 1A shows a sound capture device (MICU) located in an ideal position attached to a shirt (SHIRT) of a person (MICU-W) and configured to pick up the voice of the wearer. FIG. 1A shows the intended use of a 'clip microphone unit' for own voice pickup. The microphone array (M1, M2) is pointing (M-DIR) towards the user's mouth (MOUTH) (signal of interest), hereby enabling an efficient directional attenuation of background sounds. The background noise can be attenuated by use of directional processing, where the background noise is attenuated while the direction of the user's mouth (OV-DIR) is unaltered (cf. dashed beampattern 'DIR'). If the sound capture device (MICU) is not correctly mounted, e.g. as illustrated in FIG. 1B, the user's voice may be attenuated by the directional system. FIG. 1B shows a sound capture device positioned in a sub-optimal way, where the microphone axis (M-DIR) points away from the wearer's mouth (MOUTH). In that case, in order to ensure that the target talker (MICU-W) is not attenuated by the directional noise reduction system should be turned off so that the microphone array sensitivity becomes omni-directional (switch to an omni-directional mode, cf. dashed circular beampattern 'OMNI'). FIG. 1C shows the sound capture device (MICU) used as a table microphone. In FIG. 1C, the sound capture device is placed on a support structure (SURF), e.g. at a table, in order to pick up voices from persons sitting around the table. In that situation, a directional microphone mode may attenuate some voices of interest. Hence, an omni-directional microphone sensitivity is preferred (cf. semi-spherical beampattern 'OMNI').

Different use cases of a sound capture device according to the present disclosure, e.g. a microphone unit (MICU) as illustrated in FIG. 1A-1C, are illustrated in FIG. 2A-2D with a focus on exemplary beampatterns for controlling a mode of operations of the directional system.

Figure 2A:
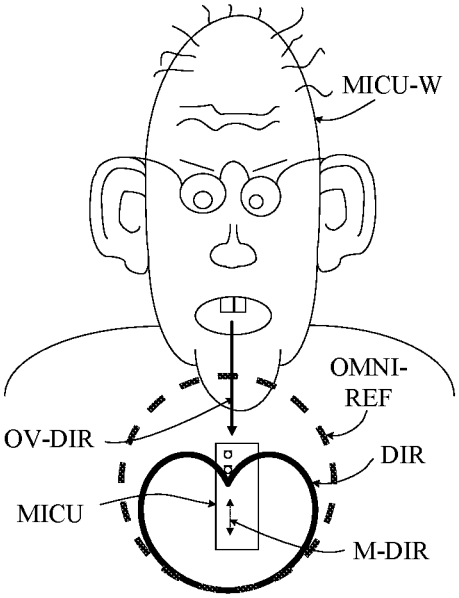
FIG. 2A illustrates a perfect target cancelling beamformer.
Figure 2B:
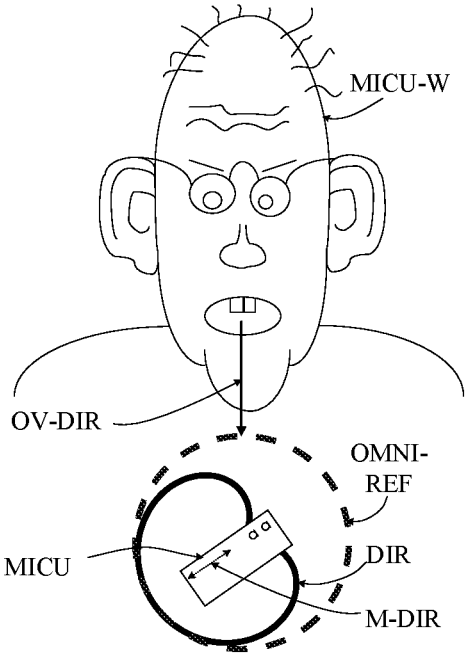
FIG. 2B illustrates a situation where the sound capture device is tilted, so that the null direction of the target cancelling beamformer does not point directly towards the user's mouth.
Figure 2C:
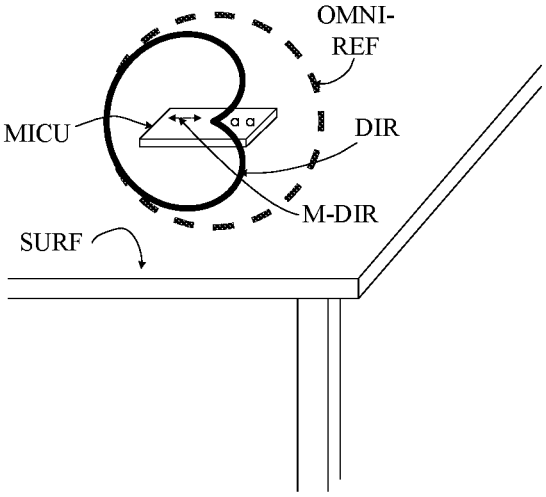
FIG. 2C illustrates a situation where the sound capture device is placed at a table.
Figure 2D:
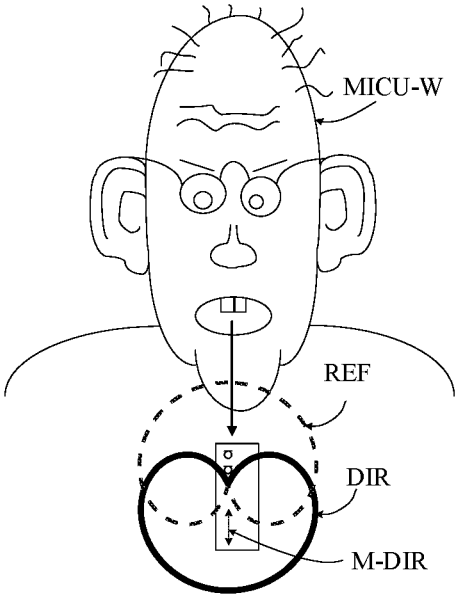
FIG. 2D illustrates a situation where the reference beampattern is cardioid-shaped with its null direction pointing away from the user's voice.

The present disclosure proposes to switch between directional and omni-directional mode in a sound capture device (MICU) based on a quality estimate of the possible directional benefit. The quality of a directional beamformer can be assessed based on an estimate of how well the null is steered towards the target talker compared to a reference beampattern such as an omni-directional beampattern. A useful building block in many adaptive noise reduction algorithms is a target cancelling beamformer. A target cancelling beamformer is a directional beampattern pointing its null towards the signal of interest, ideally fully removing the target signal and hereby obtaining an estimate of the background noise in absence of the target signal. A target cancelling beamformer may be pre-calibrated to a specific target position/direction, e.g. (ideally) the direction of the user's own voice (OV-DIR). A target cancelling beamformer is illustrated in FIG. 2A (cf. solid cardioid, denoted 'DIR'). In this situation, we would expect full benefit form a directional noise reduction system as we see a big difference between the target cancelling beamformer (DIR) and the reference beampattern (dashed circular pattern, denoted 'OMNI-REF'). The null-direction of cardioid-shaped pattern points directly towards the user's mouth (OV-DIR), hereby cancelling the voice of the user (MICU-W). The dashed beampattern shows an omni-directional reference beampattern (OMNI-REF). Considering the difference between the reference beampattern and the beampattern of the target cancelling beamformer, we see that the highest difference is obtained, when the null direction of the target beamformer is pointing directly towards the user's mouth (OV-DIR). In the case, when the sound capture device ('clip array', MICU) is tilted (FIG. 2B), the difference between the target cancelling beamformer (solid line, DIR) and the reference beampattern (dashed line, OMNI-REF) becomes smaller, and the user's voice is not fully cancelled by the target cancelling beamformer. In that case, less difference between the target cancelling beamformer and the reference omni-directional beampattern (dashed line) is seen. Similarly, when the sound capture device ('microphone array', MICU) is placed at a table (cf. 'SURF' in FIG. 2C), it is unlikely that the sounds of interest solely arrives from the pre-defined target direction (M-DIR). Voices of interest may (depending on the practical situation) arrive from any direction around the table. It is thus unlikely to observe a high average difference between the target cancelling beamformer (solid line, DIR) and the reference beampattern (dashed line, OMNI-REF). The reference beampattern does not necessarily have to be omni-directional, e.g. a cardioid pointing the opposite way of the target cancelling beamformer (solid line cardioid denoted 'DIR') may be used as reference beampattern. This is illustrated in FIG. 2D (cf. dashed line cardioid denoted 'REF'). The scenarios of FIG. 2A-2D are similar to the configurations of FIG. 1A-1C and uses the same reference names for the same elements.

The term 'beampattern' (as used throughout the present disclosure) may also be termed 'sensitivity pattern' indicating a spatial sensitivity (e.g. angle dependence) of a (directional) microphone system.

Figure 3:
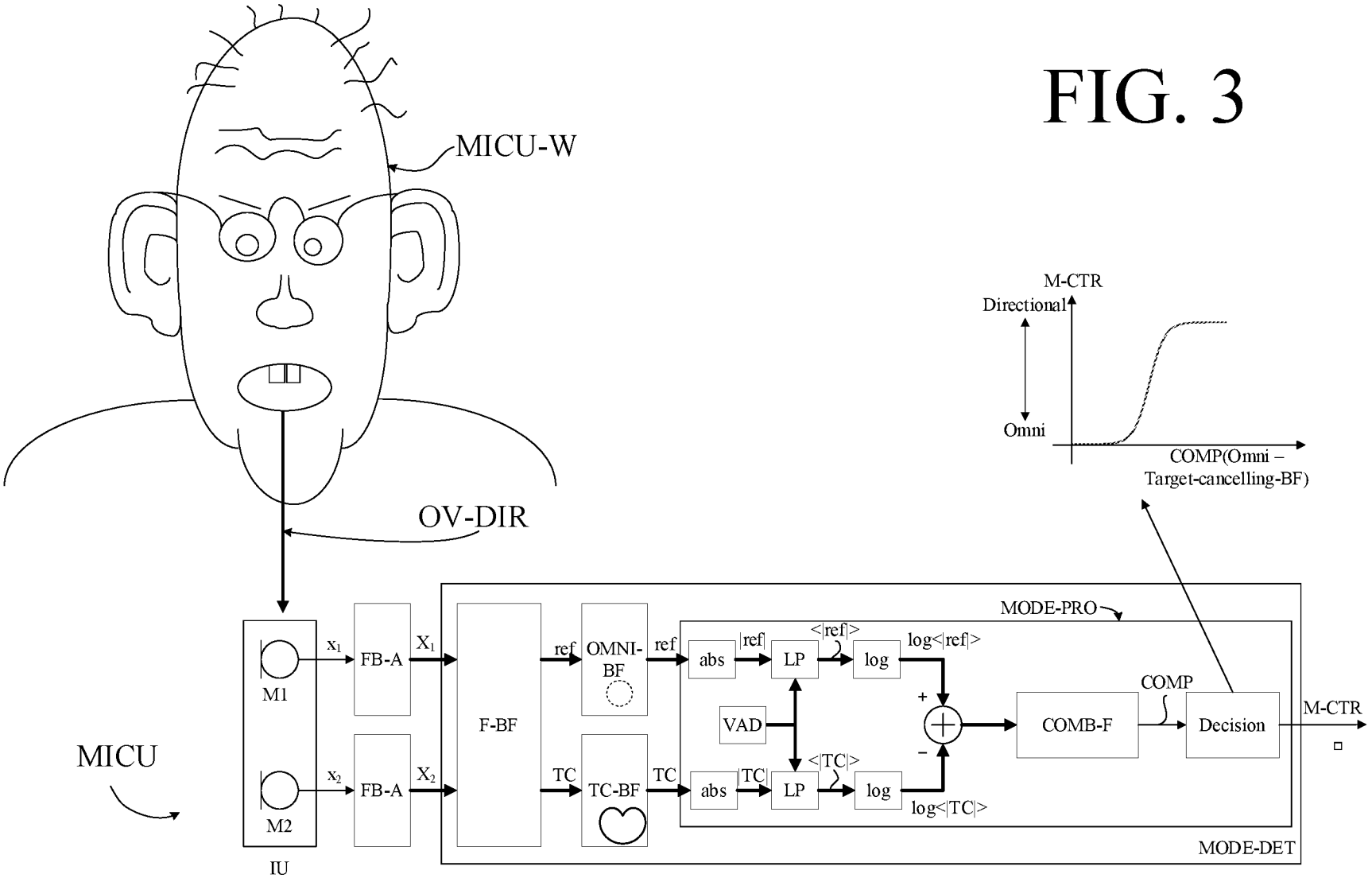
FIG. 3 shows a first embodiment of an input stage of a sound capture device, e.g. a microphone unit, or a hearing device, according to the present disclosure.
Figure 4:
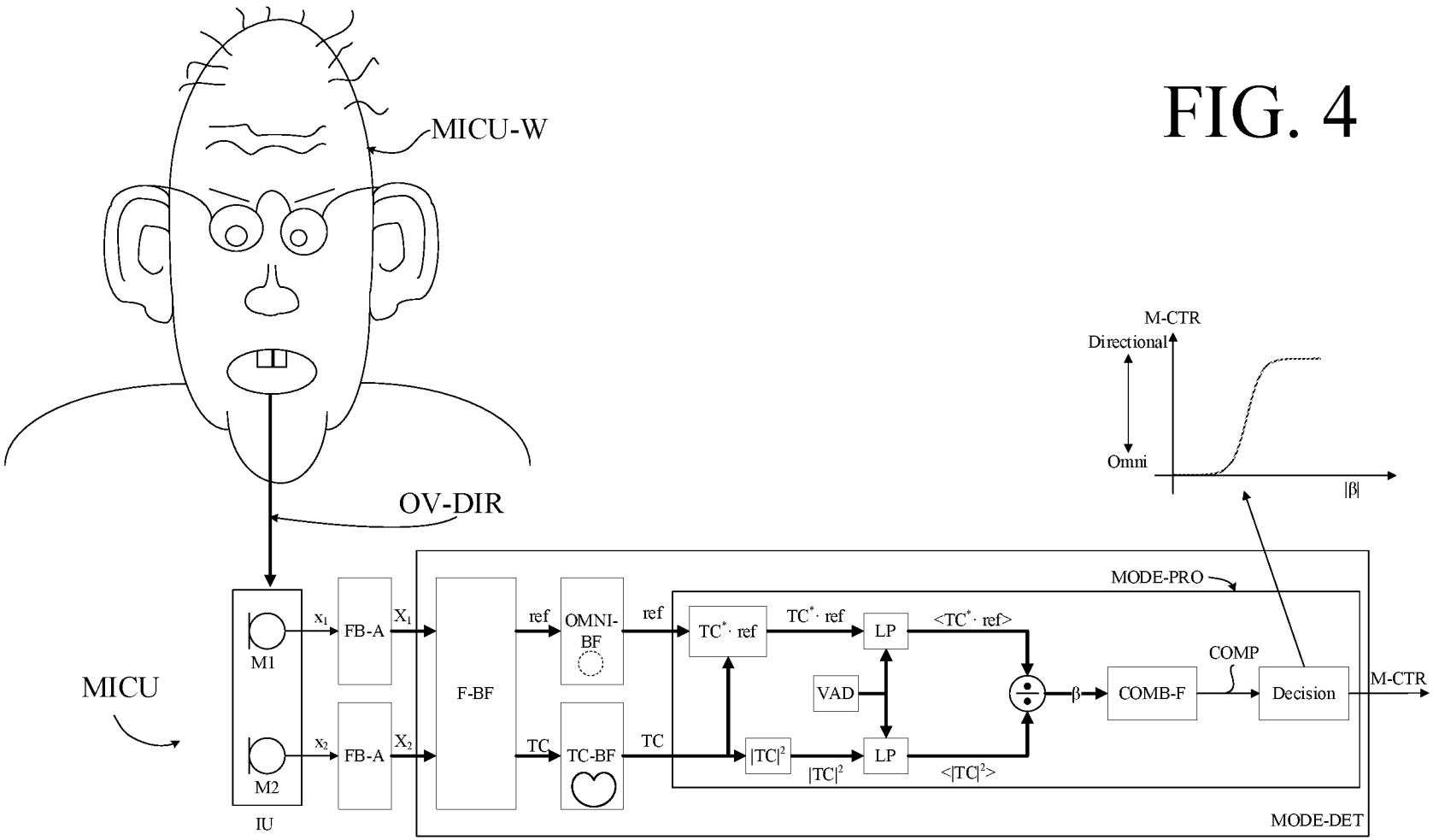
FIG. 4 shows a second embodiment of an input stage of a sound capture device, e.g. a microphone unit, according to the present disclosure.

In FIGS. 3 and 4 discussed below, embodiments of a sound capture device (MICU) comprising a mode detector (cf. rectangular enclosure denoted MODE-DET in FIG. 3, 4) according to the present disclosure using the principles indicated in FIG. 2A-2D are outlined. FIGS. 3 and 4 illustrate a wearer (MICU-W) of the sound capture device (MICU) and an ideal microphone direction (equal to a direction (OV-DIR) towards the wearer's mouth) of microphones (M1, M2) of an input unit (IU) of the sound capture device. The first and second microphones (M1, M2) provide (time domain, e.g. digitized) electric input signals $x_1$, $x_2$, respectively. The sound capture device comprises respective analysis filter banks for providing the first and second electric input signals ($x_1$, $x_2$, respectively) in a time-frequency representation ($X_1$, $X_2$, respectively). The (time-frequency domain) first and second electric input signals ($X_1$, $X_2$) are fed to the mode detector (MODE-DET), specifically to the beamformer unit (F-BF). The beamformer unit is configured to provide a number of fixed beamformers, including a reference beamformer (ref) and a target cancelling beamformer (TC), each being a linear combination of the first and second electric input signals ($X_1$, $X_2$), wherein the weights ($w_{ij}$) of the respective beamformers are complex and frequency dependent. The difference between the (reference) (e.g. omni-directional) beamformer (OMNI-BF, signal 'ref') and the target voice cancelling beamformer (TC-BF, signal 'TC') is combined into a decision across frequency bands. A high difference indicates optimal conditions for the directional noise reduction system, and directional enhancement of the user's voice is enabled. A smaller difference between the two beamformers indicates a sub-optimal condition for the directional noise reduction system. A fading between omni-directional and directional mode may be implemented for values of the difference between a first and second threshold values. The first threshold value may be lower than the second threshold value. The threshold values may be frequency dependent, e.g. different in different frequency sub-bands. Preferably, the difference between the two directional signals is only updated in presence of the user's voice. The user's voice may be detected by use of a voice activity detector. The sound capture device may e.g. be embodied in a microphone unit, e.g. adapted to communicate with another device, e.g. a hearing aid. The sound capture device may e.g. be embodied in a hearing device, e.g. a hearing aid.

FIG. 3 shows a first embodiment of an input stage of a sound capture device, e.g. a microphone unit, or a hearing device, according to the present disclosure. The magnitude, signals |ref| and |TC|, (cf. units 'abs', or squared-magnitude) of the reference beamformer (cf. 'OMNI-BF', signal ref) and the target voice cancelling beamformer (cf. TC-BF), signal TC, respectively, are averaged (e.g. by smoothing across time frames using a first order low-pass filter (cf. respective units 'LP')) in order to obtain stable estimates, cf. signals <|ref|> and <|TC|>, respectively, and hereby avoiding a fluctuating decision. Preferably, the smoothing only takes place, when the user's voice is detected. The voice may be detected by use of a voice activity detector (cf. 'VAD'), e.g. a modulation-based voice activity detector. The smoothed magnitudes of the reference beamformer (cf. 'OMNI-BF') and the target voice cancelling beamformer (cf. TC-BF) are converted to the logarithmic domain (cf. units 'log'), cf. signals log(<|ref|>) and log(<|TC|>), respectively. The difference found in separate frequency channels (cf SUM-unit '+' in FIG. 3) are combined onto a joint decision across frequency (cf block 'COMB-F'). The combination unit (COMB-F) may e.g. be implemented by a weighted sum or by logistic regression or by a neural network. The weights may be estimated based on supervised learning. Alternatively, the combination function may be tuned manually. When the estimated difference between the reference directional signal and the target voice cancelling signal is high, it indicates that the benefit of directional noise reduction is high, and the microphone unit (MICU) should switch to directional noise reduction. Otherwise, if the difference is small (e.g. smaller than 3 dB or smaller than 6 dB or smaller than 9 dB) the potential benefit of directional noise reduction is limited, and the microphone unit should switch into an omni-directional mode. The directional mode may be adaptive or fixed. The decision (cf. block 'Decision') may be a smooth transition between the different directional modes (cf. insert in FIG. 3, illustrating a smooth transition from 'omni' to 'directional' mode (represented by signal M-CTR) with increasing difference between the omni- and target-cancelling beamformers (represented by signal COMP)). Alternatively, the decision may be a binary transition between directional and omni-directional. Hysteresis may be built into the decision. In addition to solely switching between the directional and the omni-directional mode, also the frequency shaping of the audio signal may be altered based on the detected mode. The output of the mode detector (MODE-DET), here the decision block (Decision), is mode control signal M-CTR.

Another embodiment of an input stage of sound capture device according to the present disclosure is illustrated in FIG. 4. The input unit (IU) providing electric input signals ($X_1$, $X_2$) and beamformer unit (F-BF) providing fixed beamformers in the form of reference beamformer (ref) and a target cancelling beamformer (TC) of the embodiment of FIG. 4 is equivalent to the embodiment of FIG. 3. However, contrary to considering the difference between the reference beampattern (ref) and the target voice beampattern (TC) as shown in the embodiment of FIG. 3, the embodiment of FIG. 4 provides a normalized correlation coefficient β between the two directional signals $$\beta = \frac{\langle TC^* ref \rangle}{\langle |TC|^2 \rangle}$$

(cf. blocks 'TC*ref' and '$|TC|^2$' providing the same signals, and low pass filters LP (controlled by the voice activity detector VAD) providing smoothed versions (<TC*ref> and <$|TC|^2$>) of these signals, and finally combination unit (division unit ÷) providing β. This coefficient may as well be applied as adaptive coefficient in an adaptive beamformer, see e.g. [Elko and Pong; 1995] or EP3588981A1, or EP3253075A1. In situations, where the target voice is dominant (and the target cancelling beamformer is able to cancel the target signal), the value of β will increase. We may thus detect the situation of user's own voice if β frequently has a high value (own voice detection). We may thus apply directional processing, if a high value of β occurs frequently. Preferably, β is only updated if voice activity is detected, cf. VAD-unit in FIG. 4 (For other applications, such as noise reduction, β may instead be averaged based on absence of voice). As β may be calculated across frequency channels, the values should be combined into a single decision across frequency (cf. units 'COMB-F' and 'Decision'). The decision (cf. block 'Decision') may be a smooth transition between the different directional modes (cf. insert in FIG. 4, illustrating a smooth transition from 'omni' to 'directional' mode (represented by mode control signal M-CTR) with increasing absolute value of the parameter β (cf. |β| on the horizontal axis of the graph)). As in the embodiment of FIG. 3, the decision may be a binary transition between directional and omni-directional. Hysteresis may be built into the decision. In addition to solely switching between the directional and the omni-directional mode, also the frequency shaping of the audio signal may be altered based on the detected mode. The output of the mode detector (MODE-DET), here the decision block (Decision), is the mode control signal M-CTR. As in the embodiment of FIG. 3, the combination unit (COMB-F) (and/or the decision unit ('Decision')) may e.g. be implemented by a weighted sum or by logistic regression or by a neural network. The weights may be estimated based on supervised learning or by manual tuning.

Different own voice-cancelling beamformer candidates (e.g. based on predetermined beamformer weights, e.g. stored in a memory) may be provided in the embodiments described in relation to FIG. 3 and FIG. 4. The advantage of having a multitude (e.g. a few) of own voice beamformer candidates in parallel is that it becomes possible to cover a range of mouth-to-sound device distances, as the optimal own voice cancelling beamformer is distance dependent. Possible own voice candidate beamformers could e.g. cover a range of 10-30 cm from the mouth. The beamformer having the deepest null may be selected at a given point in time.

A joint decision across different frequency bands may be obtained by combining the differences (or parameter f) across frequency. The decision may be based on a trained neural network. The block 'COMB-F' or the block 'Decision' may be implemented by a trained neural network. The result of the decision in the 'Decision' block is the mode control signal (M-CTR), which may be provided as an output 'vector' of a trained neural network, where the input vector is the combined (frequency dependent) signals of the respective comparison units ('+' in FIG. 3 and '÷' in FIG. 4). In FIG. 3, the output of the comparison unit (+) and inputs to the 'Combination across frequency' unit (COMB-F) is log<|ref(k,l)|>−log<|TC(k,l)|>. In FIG. 4 outputs of the comparison unit (+) and inputs to the 'Combination across frequency' unit (COMB-F) is β(k,l), k and l being frequency and time-frame indices, respectively.

Figure 5B:
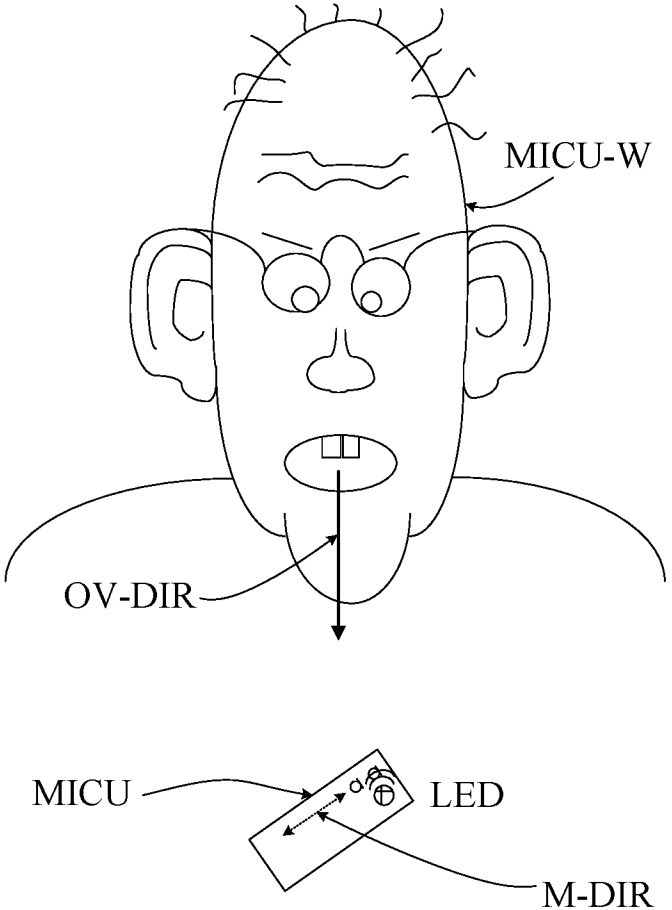
FIG. 5B shows an embodiment of a sound capture device according to the present disclosure comprising a light indicator (LED) for indicating an incorrect (non-optimal) location/orientation of the unit.
Figure 5A:
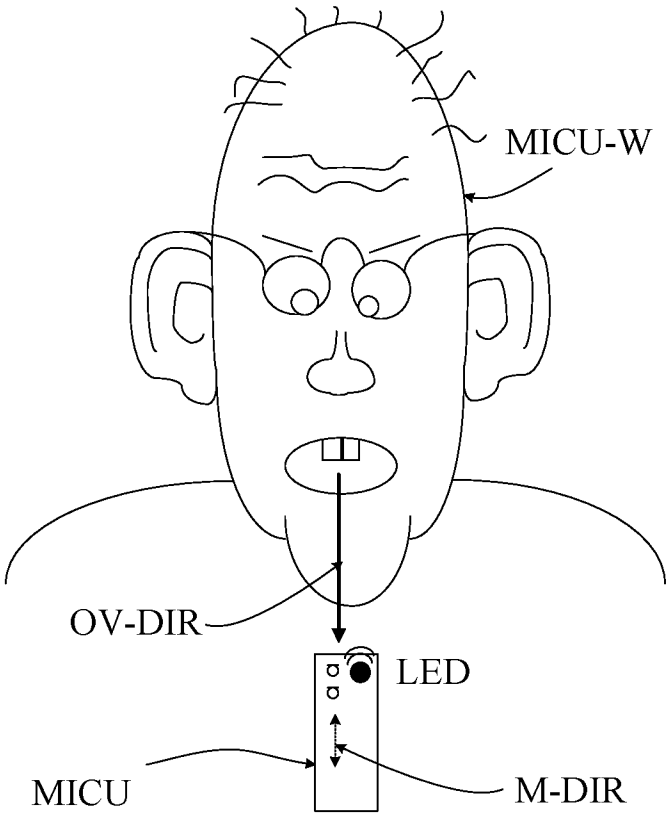
FIG. 5A shows an embodiment of a sound capture device according to the present disclosure comprising a light indicator (LED) for indicating a correct (optimal) location/orientation of the unit.

As the user (MICU-W) is only wearing but not listening to the sound capture device, when e.g. implemented as a microphone unit (MICU), an indication of the directional quality and/or how well the sound capture device is mounted may be desirable. An indication could e.g. be provided via a visual indicator, e.g. an LED or a display with information, or a haptic indicator, e.g. a vibrator, or an acoustic indicator. This is shown in FIG. 5A, 5B (which illustrate the same scenarios as FIGS. 1A and 1B, respectively). The indication could be based on the directional mode estimated by the pre-mentioned detectors. Alternatively, the indication could be based on an orientation sensor such as an accelerometer or a magnetometer. FIGS. 5A and 5B shows an embodiment of a sound capture device (MICU) according to the present disclosure comprising a light indicator (LED) for indicating a correct (optimal) (FIG. 5A) and an incorrect (non-optimal) (FIG. 5B) location/orientation of the unit on the wearer (MICU-W). The detected directional quality or an orientation of the sound capture device may e.g. be conveyed to the user via a change in colour e.g. from green to red (e.g. via yellow as an intermediate level) or via a constant to blinking pattern, etc.

Figure 6:
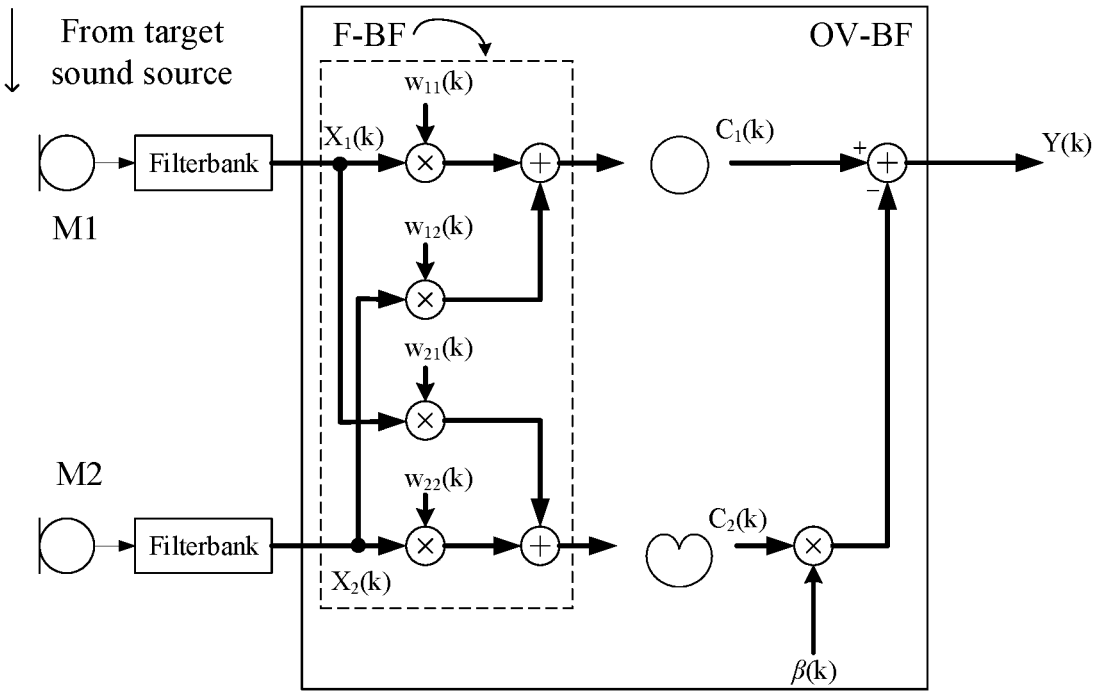
FIG. 6 shows an adaptive beamformer configuration, wherein the adaptive beamformer in the k'th frequency sub-band Y(k) is created by subtracting a (e.g. fixed) target cancelling beamformer $C_2(k)$ scaled by the adaptation factor $\beta(k)$ from an (e.g. fixed) omni-directional beamformer $C_1(k)$.
Figure 7:
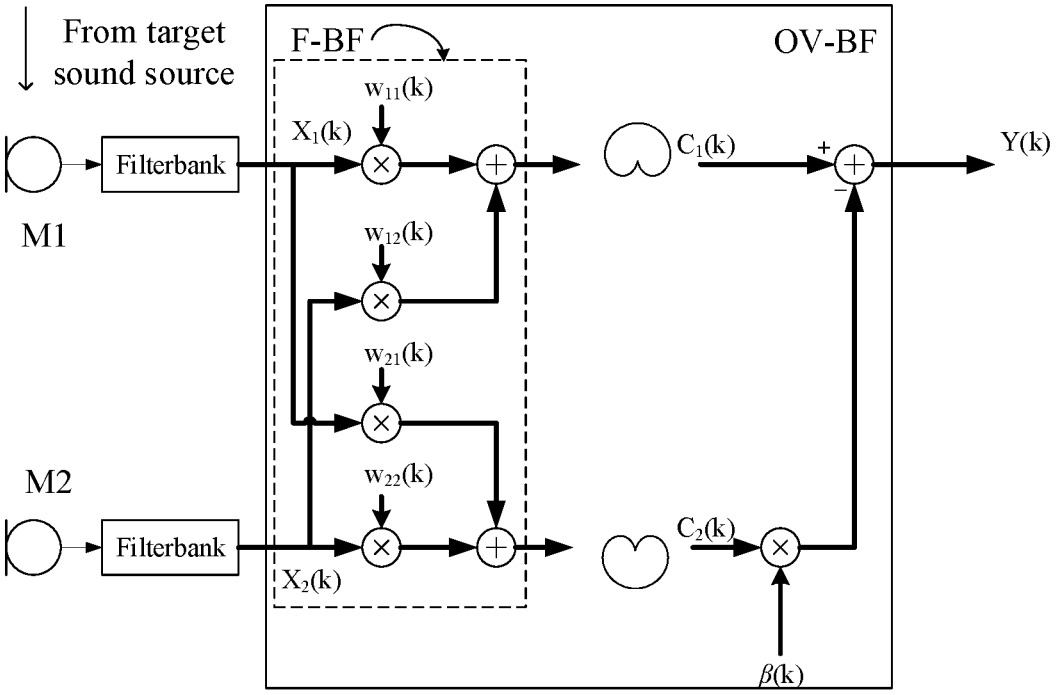
FIG. 7 shows an adaptive beamformer configuration similar to the one shown in FIG. 6, where the adaptive beampattern Y(k) is created by subtracting a target cancelling beamformer $C_2(k)$ scaled by the adaptation factor $\beta(k)$ from another fixed beampattern $C_1(k)$.

FIGS. 6 and 7 illustrate respective embodiments of adaptive beamformer configurations that may be used to implement an own voice beamformer for use in a sound capture device according to the present disclosure. FIGS. 6 and 7 both show a two-microphone configuration, which is frequently used in state of the art hearing devices, e.g. hearing aids (or other sound capture devices). The beamformers may however be based on more than two microphones, e.g. on three or more (e.g. as a linear array or possibly arranged in a non-linear configuration). An adaptive beampattern (Y(k)), for a given frequency band k, is obtained by linearly combining two beamformers $C_1(k)$ and $C_2(k)$. $C_1(k)$ and $C_2(k)$ (time indices have been skipped for simplicity), each representing different (possibly fixed) linear combinations of first and second electric input signals $X_1$ and $X_2$, from first and second microphones M1 and M2, respectively. The first and second electric input signals $X_1$ and $X_2$ are provided by respective analysis filter banks ('Filterbank'). The frequency domain signals (downstream of the respective analysis filter banks ('Filterbank') are indicated with bold arrows, whereas the time domain nature of the outputs of the first and second microphones (M1, M2) are indicated as thin line arrows. The block 'F-BF' in FIGS. 3 and 4 providing fixed beamformers 'ref' and 'TC' is equivalent to the block 'F-BF' indicated by solid rectangular enclosure in FIGS. 6 and 7. Signals ref and TC of FIGS. 3 and 4 are equal to signals $C_1(k)$ and $C_2(k)$, respectively, of FIG. 6. In another embodiment, signals 'ref' and 'TC' of FIGS. 3 and 4 may be equal to signals $C_1(k)$ and $C_2(k)$, respectively, of FIG. 7.

FIG. 6 shows an adaptive beamformer configuration, wherein the adaptive beamformer in the k'th frequency sub-band Y(k) is created by subtracting a (e.g. fixed) target cancelling beamformer C2(*k*) scaled by the adaptation factor β(k) from an (e.g. fixed) omni-directional beamformer C1(*k*). The adaptation factor β may e.g. be determined as $$\beta = \frac{\langle C_2^* C_1 \rangle}{\langle |C_2|^2 \rangle}$$

The two beamformers $C_1$ and $C_2$ of FIG. 6 are e.g. orthogonal. This is actually not necessarily the case, though. The beamformers of FIG. 7 are not orthogonal. When the beamformers $C_1$ and $C_2$ are orthogonal, uncorrelated noise will be attenuated when β=0.

Whereas the (reference) beampattern $C_1(k)$ in FIG. 6 is an omni-directional beampattern (cf. e.g. FIG. 2A), the (reference) beampattern $C_1(k)$ in FIG. 7 is a beamformer with a null towards the opposite direction of that of $C_2(k)$ (cf. e.g. FIG. 2D). Other sets of fixed beampatterns $C_1(k)$ and $C_2(k)$ may as well be used.

FIG. 7 shows an adaptive beamformer configuration similar to the one shown in FIG. 6, where the adaptive beampattern Y(k) is created by subtracting a target cancelling beamformer $C_2(k)$ scaled by the adaptation factor β(k) from another fixed beampattern $C_1(k)$. This set of beamformers are not orthogonal. In case that $C_2$ in FIGS. 6 and 7 represents an own voice-cancelling beamformer, β will increase, when own voice is present.

The beampatterns could e.g. be the combination of an omni-directional delay-and-sum-beamformer $C_1(k)$ and a delay-and-subtract-beamformer $C_2(k)$ with its null direction pointing towards the target direction (e.g. the mouth of the person wearing the device, i.e. a target-cancelling beamformer) as shown in FIG. 6 or it could be two delay-and-subtract-beamformers as shown in FIG. 7, where one, $C_1(k)$, has maximum gain towards the target direction, and the other beamformer, $C_2(k)$, is a target-cancelling beamformer. Other combinations of beamformers may as well be applied. Preferably, the beamformers should be orthogonal, i.e. $[w_{11}\ w_{12}][w_{21} w_{22}]^H=0$. The adaptive beampattern arises by scaling the target cancelling beamformer $C_2(k)$ by a complex-valued, frequency-dependent, e.g. adaptively updated scaling factor β(k) and subtracting it from the $C_1(k)$, i.e.

$$Y(k)=C_1(k)-\beta(k)C_2(k)=w_1^H(k)x(k)-\beta(k)w_2^H(k)x(k).$$

Where $w_1^H=[w_{11}, w_{12}]$, $w_2^H=[w_{21}, w_{22}]$ are complex beamformer weights according to FIG. 6 or FIG. 7 and $x=[x_1, x_2]^T$ is the input signals at the two microphones (after filter bank processing).

In the context of FIGS. 6 and 7, the fixed reference beamformer, ref, of FIGS. 3 and 4 is thus equal to $C_1=w_1^H(k)x(k)$, and the fixed target-cancelling beamformer, TC, is equal to $C_2=w_2^H(k)x(k)$, where $w_1^H=[w_{11}, w_{12}]$, and $w_2^H=[w_{21}, w_{22}]$ are complex beamformer weights, e.g. predetermined and stored in a memory (or occasionally updated during use), and $x=[x_1, x_2]^T$ represent the (current) electric input signals at the two microphones (after filter bank processing).

Figure 8:
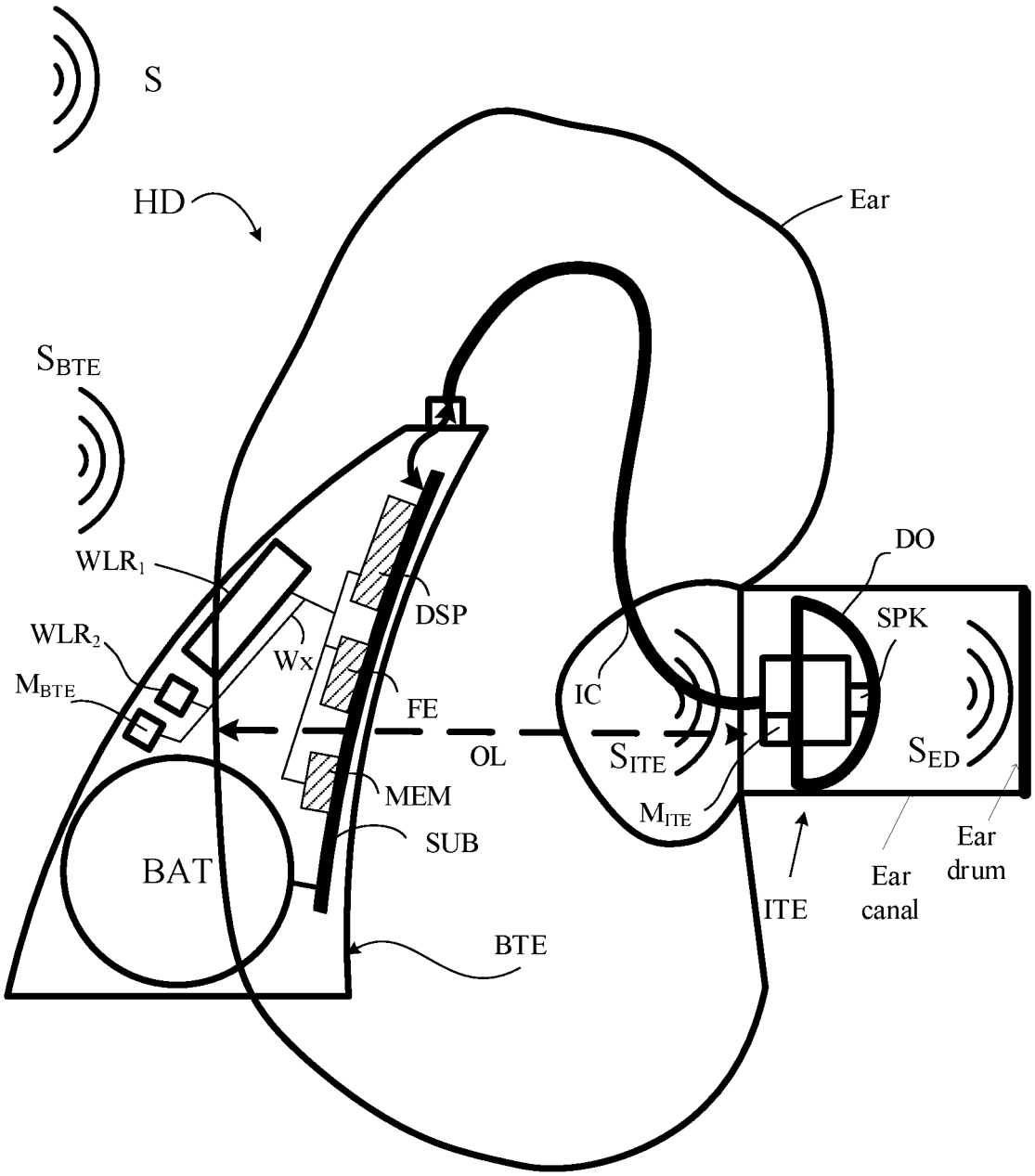
FIG. 8 shows an embodiment of a hearing device according to the present disclosure comprising a BTE-part as well as an ITE-part.

FIG. 8 shows an embodiment of a hearing device according to the present disclosure comprising a BTE-part as well as an ITE-part. FIG. 8 shows an embodiment of a hearing device according to the present disclosure comprising at least two input transducers, e.g. microphones, located in a BTE-part and/or in an ITE-part. The hearing device (HD) of FIG. 8, e.g. a hearing aid, comprises a BTE-part (BTE) adapted for being located at or behind an ear of a user and an ITE-part (ITE) adapted for being located in or at an ear canal of a user's ear. The BTE-part and the ITE-part are connected (e.g. electrically connected) by a connecting element (IC) and internal wiring in the ITE- and BTE-parts (cf. e.g. schematically illustrated as wiring Wx in the BTE-part). The BTE- and ITE-parts may each comprise an input transducer, e.g. a microphone ($M_{BTE}$ and $M_{ITE}$), respectively, which are used to pick up sounds from the environment of a user wearing the hearing device, and—in certain modes of operation—to pick up the voice of the user. The ITE-part may comprise a mould intended to allow a relatively large sound pressure level to be delivered to the ear drum of the user (e.g. a user having a severe-to-profound hearing loss). An output transducer, e.g. a loudspeaker, may be located in the BTE-part and the connecting element (IC) may comprise a tube for acoustically propagating sound to an ear mould and through the ear mould to the eardrum of the user.

The hearing device (HD) comprises an input unit comprising two or more input transducers (e.g. microphones) (each for providing an electric input audio signal representative of an input sound signal). The input unit further comprises two (e.g. individually selectable) wireless receivers ($WLR_1$, $WLR_2$) for providing respective directly received auxiliary audio input and/or control or information signals. The BTE-part comprises a substrate SUB whereon a number of electronic components (MEM, FE, DSP) are mounted. The BTE-part comprises a configurable signal processor (DSP) and memory (MEM) accessible therefrom. In an embodiment, the signal processor (DSP) form part of an integrated circuit, e.g. a (mainly) digital integrated circuit, whereas the front-end chip (FE) comprises mainly analogue circuitry and/or mixed analogue digital circuitry (including interfaces to microphones and loudspeaker).

The hearing device (HD) comprises an output transducer (SPK) providing an enhanced output signal as stimuli perceivable by the user as sound based on an enhanced audio signal from the signal processor (DSP) or a signal derived therefrom. Alternatively or additionally, the enhanced audio signal from the signal processor (DSP) may be further processed and/or transmitted to another device depending on the specific application scenario.

In the embodiment of a hearing device in FIG. 8, the ITE part comprises the output unit in the form of a loudspeaker (sometimes termed 'receiver') (SPK) for converting an electric signal to an acoustic signal. The ITE-part of the embodiments of FIG. 8 also comprises input transducer ($M_{ITE}$, e.g. a microphone) for picking up a sound from the environment. The input transducer ($M_{ITE}$) may—depending on the acoustic environment—pick up more or less sound from the output transducer (SPK) (unintentional acoustic feedback). The ITE-part further comprises a guiding element, e.g. a dome or mould or micro-mould (DO) for guiding and positioning the ITE-part in the ear canal (Ear canal) of the user.

In the scenario of FIG. 8, a (far-field) (target) sound source S is propagated (and mixed with other sounds of the environment) to respective sound fields at the BTE microphone ($M_{BTE}$) of the BTE-part $S_{ITE}$ at the ITE microphone ($M_{ITE}$) of the ITE-part, and $S_{ED}$ at the ear drum (Ear drum)

The hearing devices (HD) exemplified in FIG. 8 represent a portable device and further comprises a battery (BAT), e.g. a rechargeable battery, for energizing electronic components of the BTE- and ITE-parts. The hearing device of FIG. 8 may in various embodiments implement an own voice detector (OVD) according to the present disclosure (cf. e.g. FIG. 9). The own voice detector may e.g. be used in connection with a telephone mode, and/or in connection with a voice control interface, cf. e.g. FIG. 10, 11.

In an embodiment, the hearing device (HD), e.g. a hearing aid (e.g. the processor (DSP)), is adapted to provide a frequency dependent gain and/or a level dependent compression and/or a transposition (with or without frequency compression) of one or frequency ranges to one or more other frequency ranges, e.g. to compensate for a hearing impairment of a user.

The hearing device of FIG. 8 contains two input transducers ($M_{BTE}$ and $M_{ITE}$), e.g. microphones, one ($M_{ITE}$, in the ITE-part) is located in or at the ear canal of a user and the other ($M_{BTE}$, in the BTE-part) is located elsewhere at the ear of the user (e.g. behind the ear (pinna) of the user), when the hearing device is operationally mounted on the head of the user. In the embodiment of FIG. 8, the hearing device may be configured to provide that the two input transducers ($M_{BTE}$ and $M_{ITE}$) are located along a substantially horizontal line (OL) when the hearing device is mounted at the ear of the user in a normal, operational state (cf. e.g. input transducers $M_{BTE}$, $M_{ITE}$ and double arrowed, dashed line OL in FIG. 8). This has the advantage of facilitating beamforming of the electric input signals from the input transducers in an appropriate (horizontal) direction, e.g. in the 'look direction' of the user (e.g. towards a target sound source). The microphones may alternatively be located so that their axis points towards the user's mouth. Or, a further microphone may be included to provide such microphone axis together with one of the other microphones, to thereby improve the pick-up of the wearer's voice.

Figure 9:
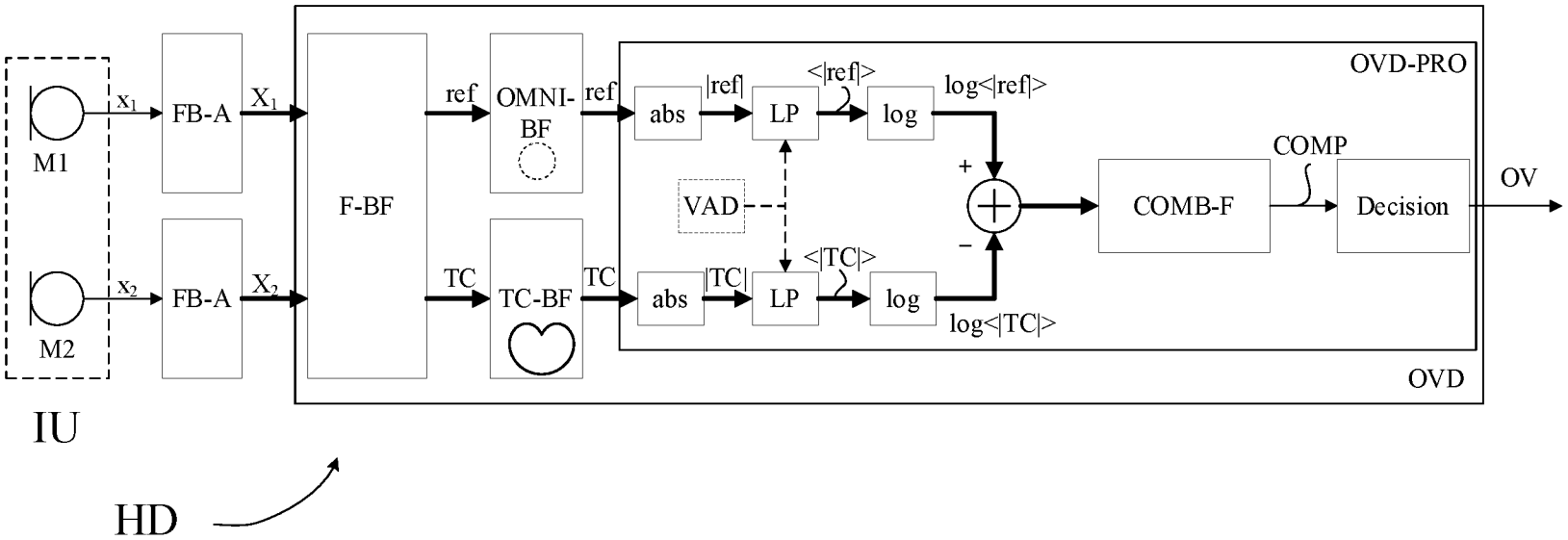
FIG. 9 shows an embodiment of an own voice detector according to the present disclosure.

FIG. 9 shows an embodiment of an input stage of a sound capture device, e.g. a hearing device comprising an own voice detector (OVD) according to the present disclosure. The own voice detector (OVD) is configured to provide an own voice control signal (OV) indicative of whether or not, or with what probability, a given electric input signal ($X_1$, $X_2$), or a processed version thereof, originates from the voice of a user wearing the device (e.g. a sound capture device or a hearing device, e.g. a hearing aid) comprising the own voice detector. The own voice detector is configured to receive a multitude M of electric input signals ($X_m$, m=1, . . . , M, here M=2, $X_1$, $X_2$) provided in a time-frequency representation (k,l), where k and l are frequency and time frame indices, respectively. The own voice detector (OVD) comprises a beamformer unit operationally coupled to a multitude of input transducers $IT_m$, m=1, . . . , M, here microphones (M1, M2) providing the multitude of electric input signals ($X_1$, $X_2$). The beamformer unit (F-BF) comprises at least two fixed beamformers including a target maintaining beamformer ('OMNI-REF', termed the 'reference beamformer') configured to leave signal components from a fixed target direction un-attenuated or less attenuated relative to signal components from other directions, and providing a current reference signal (ref). The beamformer unit (F-BF) further comprises a target cancelling beamformer (TC-BF) configured to attenuate signal components from the target direction, whereas signal components from other directions are attenuated less relative to signal components from the target direction, and providing a current target cancelling signal (TC). The fixed target direction is e.g. a direction from the hearing aid (e.g. the hearing aid microphones) towards the user's mouth and the target signal is the user's own voice. The fixed beamformers (ref, TC) are e.g. the fixed beamformers discussed in connection with FIGS. 6 and 7 based on respective sets of frequency dependent beamformer weights ($w_{11}$, $w_{12}$, $w_{21}$, $w_{22}$), e.g. stored in a memory. The own voice detector (OVD) further comprises a controller (OVD-PRO) for determining the own voice control signal (OV) in dependence of the current reference signal (ref) and the current target cancelling signal (TC). The controller (OVD-PRO) comprises respective signal paths of the reference beamformer signal (ref) and the target voice cancelling beamformer signal (TC), each signal path comprising blocks 'abs, 'LP, and 'log' to provide signals log (<|ref|>) and log(<|TC|>), respectively, and summation unit ('+') for providing a resulting difference (in a frequency sub-band representation) between the two signals (log (<|ref|>)−log(<|TC|>)), as described for the embodiment of a mode detector (MODE-DET) in connection with FIG. 3. As in FIG. 3, the smoothing provided by the low pass filters (LP) are preferably only performed when the user's voice is detected (the optional feature is indicated by the dashed outline of the VAD and the VAD control signals t the LP-unit. The difference found in separate frequency channels (cf. SUM-unit '+' in FIG. 9) are (as also described in connection with FIG. 3) combined onto a joint decision across frequency (cf. blocks 'COMB-F' and 'Decision') in substantially the same way (large difference=>high probability of own-voice presence, small difference=>small probability of own-voice presence). Again, the blocks 'COMB-F' and/or 'Decision' may be implemented as logic blocks or as a trained neural network.

Figure 10:
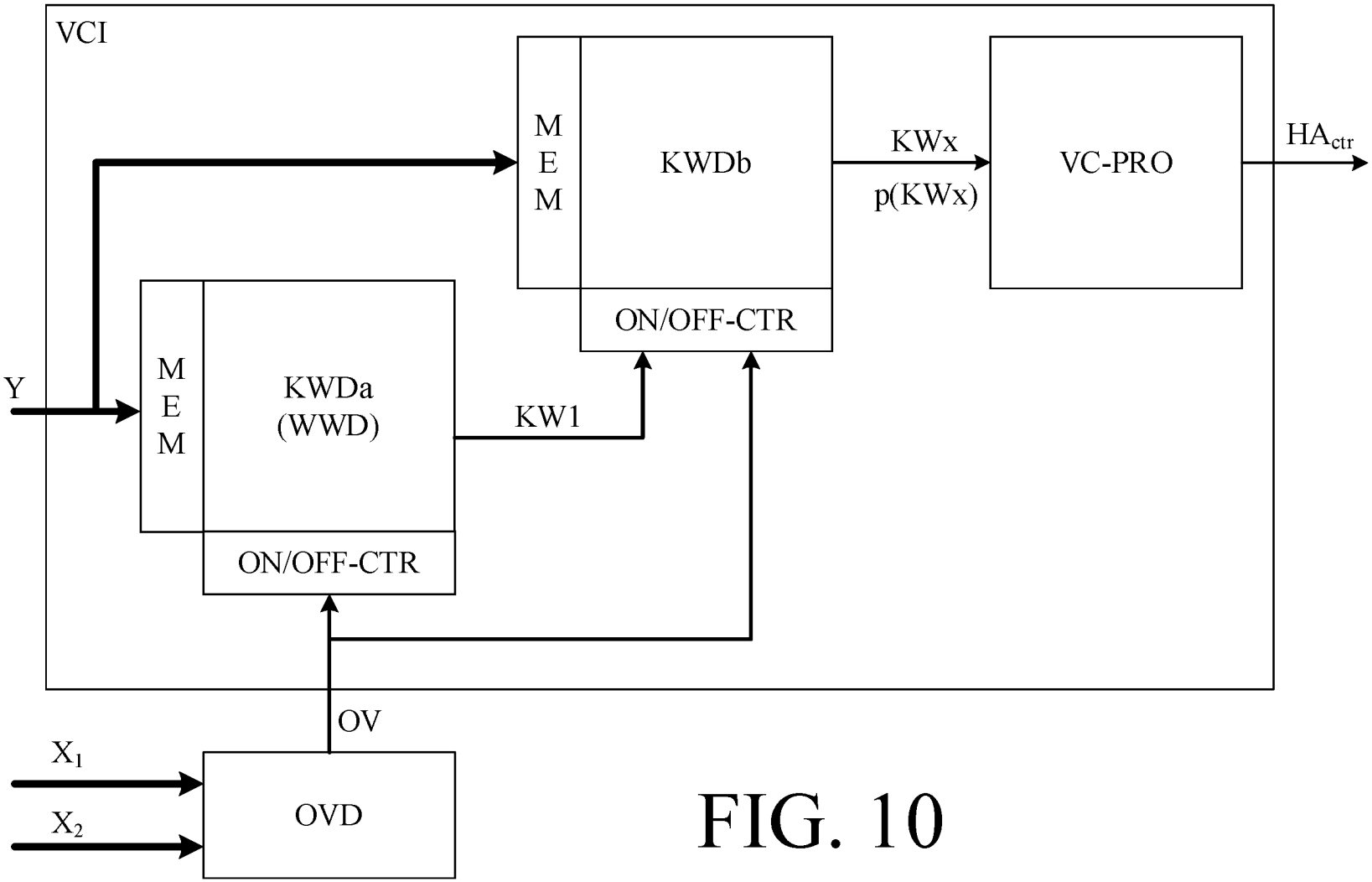
FIG. 10 shows a voice control interface connected to an own voice detector according to the present disclosure.

FIG. 10 shows a voice control interface (VCI), e.g. for a sound capture device, e.g. a microphone unit, or a hearing device, such as a hearing aid. The voice control interface (VCI) is connected to an own voice detector (OVD) according to the present disclosure (as e.g. shown in FIG. 9). The voice control interface (VCI) of FIG. 10 comprises a keyword spotting system configured to detect whether or not, or with what probability, a particular keyword KWx (x=1, . . . , Q) is present in a current audio stream (here signal Y, e.g. from own voice beamformer Y of FIG. 6 or 7) presented to the keyword spotting system. In the embodiment of FIG. 10, the keyword spotting system comprises a keyword detector (KWD) that is split into first and second parts (KWDa, KWDb). The first part of the keyword detector (KWDa) comprises a wake-word detector (WWD), denoted KWDa (WWD) for detecting a specific wake-word (KW1) of the voice control interface (VCI) of the device in question, e.g. a hearing device (to thereby save power). The second part of the keyword detector (KWDb) is configured to detect the rest of the limited number of keywords (KWx, x=2, . . . , Q). The voice interface of the hearing device is configured to be activated by the specific wake-word spoken by the user wearing the hearing device. The activation of the second part of the keyword detector (KWDb) is in the embodiment of FIG. 10 made dependent of the own voice indicator (OV) from the own voice detector (OVD), in dependence of electric input signals $X_1$, $X_2$, as well as the detection of the wake-word (KW1) by the first part of the keyword detector (KWDa) (the wake-word detector). The voice control interface (VCI) comprises a memory (MEM) for storing a current time segment of the input audio stream (Y) thereby allowing to detect a period of own voice absence in the own voice indicator (OV), before a wake word (or other keyword) is detected by the keyword detector. The first and/or the second parts of the keyword detector may be implemented as respective (trained) neural networks, whose weights are determined in advance of use (or during a training session, while using the device in question, e.g. a hearing device) and applied to respective networks. The voice control interface may be configured to control functionality of the device it forms part of, e.g. a hearing device. The keywords detectable by the keyword detector may comprise command words configured to control functionality of the device, e.g. mode shift, volume control, program shift, telephone call control, directionality, etc. The voice control interface (VCI) comprises a voice control interface controller (VC-PRO) for converting identified keywords (KWx) by the keyword detector (KWDb) to corresponding control signal(s) $HA_{ctr}$ for controlling functionality of the device it forms part of, here e.g. a hearing aid as described in FIG. 11.

Figure 11:
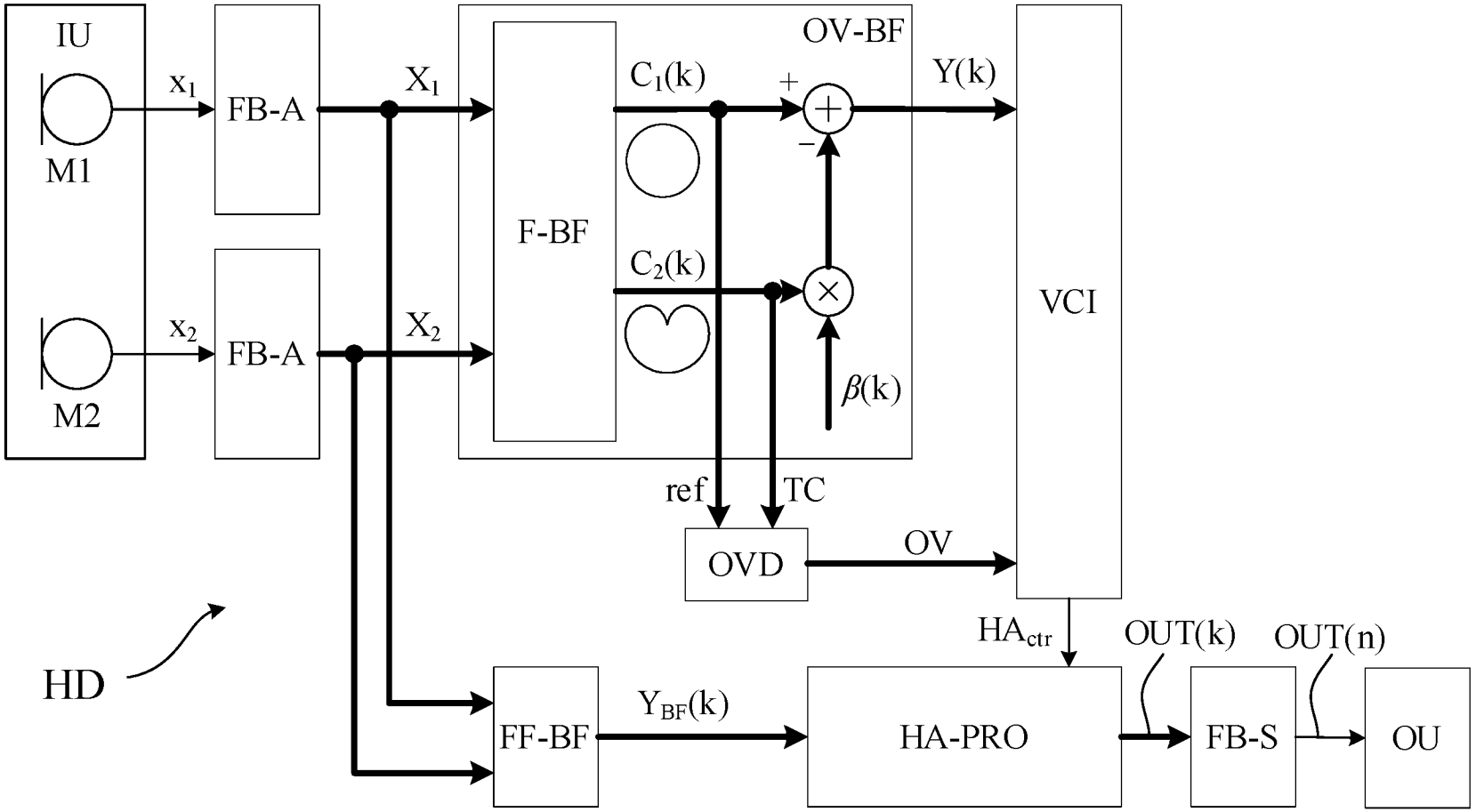
FIG. 11 shows a block diagram of a hearing device comprising an own voice detector according to the present disclosure.

FIG. 11 shows a block diagram of a hearing device (HD), e.g. a hearing aid, configured to be worn by a user, and optionally to compensate for a hearing impairment of the user. The hearing aid (HD) comprises an own voice detector (OVD) according to the present disclosure, as e.g. described in connection with FIG. 9. The own voice detector (OVD) provides an own voice control signal (OV) indicative of whether or not, or with what probability, a given electric input signal ($X_1$, $X_2$), or a processed version thereof, originates from the voice of the user. The hearing aid comprises an input unit (IU) comprising first and second microphones (M1, M2) adapted to provide (time domain, e.g. digitized) electric input signals ($x_1$, $x_2$), respectively. The hearing device comprises respective analysis filter banks (FB-A) for providing the first and second electric input signals ($x_1$, $x_2$) in a time-frequency representation ($X_1$, $X_2$). The (time-frequency domain) first and second electric input signals ($X_1$, $X_2$) are fed to an own voice beamformer (OV-BF) providing an estimate of the user's own voice (Y), e.g. as described in connection with FIG. 6, 7. In the embodiment of FIG. 11, the own voice detector (OVD) is partitioned to share the provision of beamformer signals (ref and TC) with the own voice beamformer (OV-BF). The reference (target maintaining) and target-cancelling beamformer signals (ref and TC, respectively) are fed to (own voice detection) controller (OVD-PRO) for determining the own voice control signal (OV) in dependence of the current reference signal (ref) and the current target cancelling signal (TC) as described in connection with FIG. 9. The estimate of the user's own voice (Y) from the own-voice beamformer (OV-BF) and the corresponding own-voice indicator from the own voice detector (here OVD-PRO) are fed to the voice interface (VCI), as e.g. described in FIG. 10, for providing a control signal $HA_{ctr}$ for controlling functionality of the hearing aid. The hearing aid comprises a forward (signal) path from input unit (IU) to output unit (OU). The forward path comprises respective analysis filter banks (FB-A) providing respective electric input signals ($X_1$, $X_2$) in a time-frequency representation as described above. The electric input signals ($X_1$, $X_2$) are fed to a (far-field) beamformer unit (FF-BF) for providing a beamformed signal $Y_{BF}$ representing (spatially filtered) sound from the environment (e.g. sound from a communication partner). The forward path further comprises a signal processor (HA-PRO) for applying one or more processing algorithms to the beamformed signal $Y_{BF}$. The one or more processing algorithms may e.g. comprise a compressive amplification algorithm for compensating for a hearing impairment of the user (by applying a frequency and level dependent gain to a signal of the forward path, e.g. the beamformed signal $Y_{BF}$). The signal processor (HA-PRO), e.g. the one or more processing algorithms, may e.g. be controlled via control signal $HA_{ctr}$ from the voice control interface (VCI). The signal processor (HA-PRO) provides a processed signal OUT to a synthesis filter bank (FB-S) that converts the time-frequency domain signal OUT to a time domain signal out that is fed to the output unit (OU). The output unit may comprise appropriate digital to analogue converter functionality and an output transducer, e.g. in the form of a loudspeaker of an air conduction type hearing aid and/or a vibrator of a bone-conduction type hearing aid. The output unit may also or alternatively comprise an electrode array of a cochlear implant type hearing aid for electrically stimulating the cochlear nerve, in which case the synthesis filter bank may be dispensed with.

Figure 12:
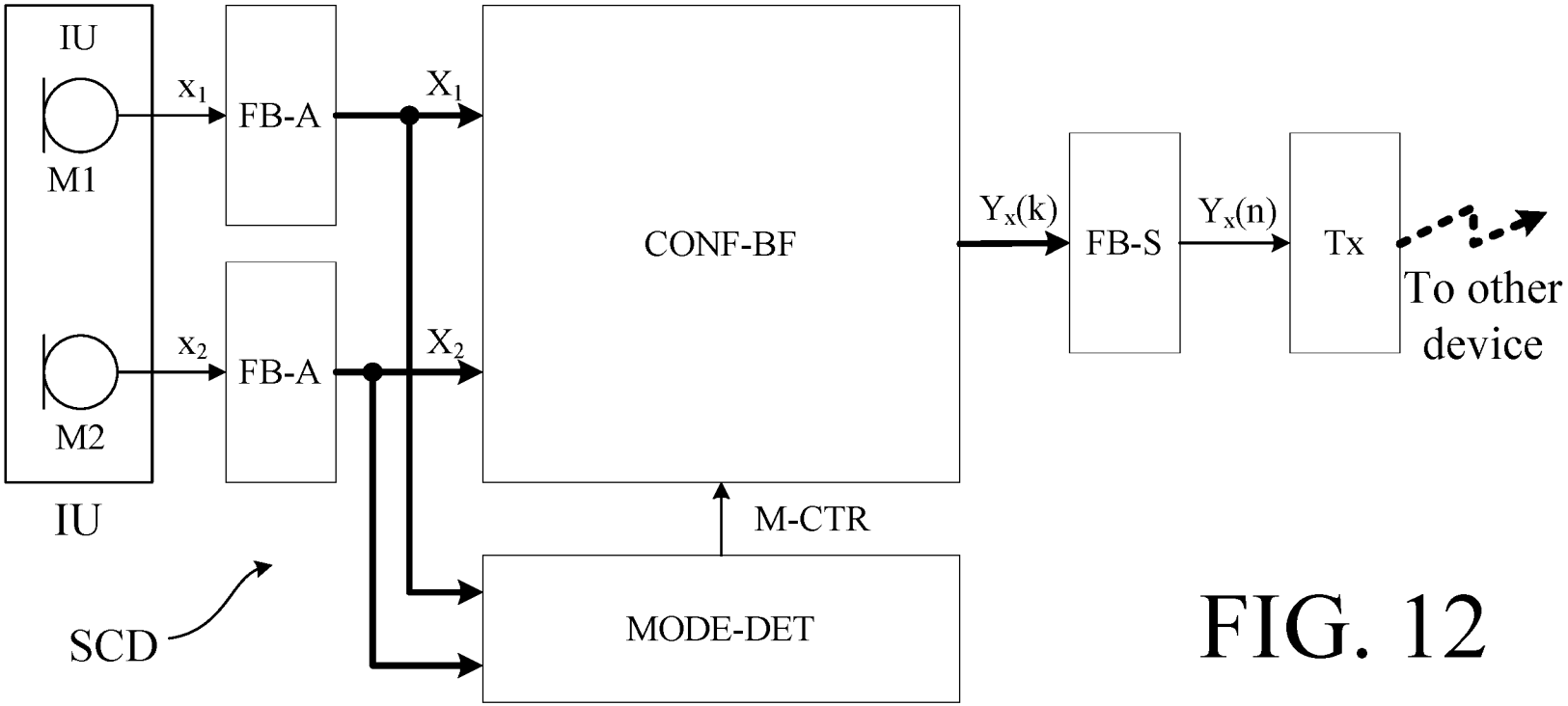
FIG. 12 shows a block diagram of a sound capture device comprising a mode detector according to the present disclosure.

FIG. 12 shows a sound capture device (SCD), e.g. a microphone unit, adapted to—in a first use case—be worn by a person and to pick up a voice of the person ('the wearer'), and optionally—in a second use case—to be located on a surface, e.g. a table, and in that mode to pick up sound from the environment (e.g. from persons speaking). The sound capture device (SCD) comprises a mode detector (MODE-DET) according to the present disclosure, as described in connection with FIG. 3, 4. The mode detector (MODE-DET) provides mode control signal (MCTR) in dependence of respective reference (ref) and target cancelling (TC) beamformer signals at a given point in time (cf. FIG. 3, 4). The input stage of the sound capture device (SCD) comprises input unit (IU) comprising first and second microphones (M1, M2) adapted to provide (time domain, e.g. digitized) electric input signals ($x_1$, $x_2$), respectively, and respective analysis filter banks (FB-A) for providing the first and second electric input signals ($x_1$, $x_2$) in a time-frequency representation ($X_1$, $X_2$). The (time-frequency domain) first and second electric input signals ($X_1$, $X_2$) are fed to a configurable noise reduction system (CONF-BF) for providing a configurable output signal ($Y_x$) in dependence of the mode control signal (M-CTR). In the first use case, where the sound capture device (SCD) is worn by a person, the noise reduction system (CONF-BF) is configured to provide an estimate ($Y_x$) of the user's own voice, e.g. as described in connection with FIG. 6, 7, when the mode control signal (M-CTR) indicates a good match between the microphone direction of the microphones of the input unit with the direction to the wearer's mouth (M-DIR and OV-DIR, respectively, in FIG. 1A, 2A, 2D). In the first use case, when the mode control signal (M-CTR) indicates a poor match between the microphone direction (M-DIR) of the microphones of the input unit with the direction to the wearer's mouth (OV-DIR) (cf. FIG. 1B, 2B), the noise reduction system (CONF-BF) is configured to provide an omni-directional signal (e.g. from one of the microphones, e.g. from M1 (or from the target maintaining beamformer (signal 'ref')). In the second use case, where the sound capture device (SCD) is located on a carrier, e.g. a table, the same functionality of the directional noise reduction system (CONF-BF) is provided in dependence of the mode control signal (M-CTR). In the second use case, however, the 'directional mode' is only fulfilled for a person located along the microphone axis (M-DIR) of the sound capture device (SCD). In case that only one person is intended to be listened to, the sound capture device (SCD) may preferably be located so that the microphone axis points towards that person. Otherwise, the directional noise reduction system (CONF-BF) will be in an omni-directional mode providing signal $Y_x$ as an omni-directional signal. The sound capture device (SCD) further comprises a synthesis filter bank (FB-S) for converting time-frequency signal $Y_x(k,l)$ to a time-domain signal $Y_x(n)$, where k, l and n are frequency (k) and time (l, n) indices, respectively. The sound capture device (SCD) further comprises a transmitter (Tx) for (e.g. wirelessly) transmitting signal $Y_x(n)$ representing sound picked up by the sound capture device (SCD) to another device, e.g. a telephone, a PC, hearing aid, or other communication device (cf. indication 'To other device').

Free Fall Detection:

As the sound capture device (MICU) may comprise a movement sensor, such as an accelerometer, it is possible to detect the onset of a free fall, which could be caused by the user losing his or her grip on the device. As there is a risk that the sound capture device (MICU) will fall on a hard surface, there is the additional risk that the impact noise produced in the impact with the hard surface, such as the floor, and possible subsequent bouncing of the sound capture device (MICU) on the surface, there is a need to mitigate this risk of loud noise as it may cause a disturbing sound to be produced by the hearing aid output transducer. When the sound capture device (MICU) detects that a free fall has occurred, there are some options to mitigate the possible impact noise. A first option is to mute the input signal, i.e. stop recording the input signal from the microphones and then either transmit signals without any sound information to the hearing aid, or to interrupt transmission of signals to the hearing aid. Another option is to transmit a signal from the sound capture device (MICU) to the hearing aid indicating that a free fall of the sound capture device (MICU) has been detected, and that the sound from the processor to the output transducer is to be muted, or at least dampened, or, even that a special noise cancellation process is to be initiated.

As to the normal operation of the sound from the sound capture device (MICU) being resumed, a timer function may be implemented. The timer may be triggered in either the sound capture device (MICU) and/or in the hearing aid, where after sound may be resumed to the previous level as prior to the onset of the free fall. The resumption may include a gradual increase, such as a ramping-up or fade-in period, where the sound volume is increased from none to operational level, or a predefined level, over a predefined period of time or with a fixed step size. This may allow the user of the sound capture device (MICU) to locate the device again using the sound signal, and to allow the user to regain an understanding of sounds in the surrounding environment. The resumption of the sound transmission may also be offset by a signal from the accelerometer that the sound capture device (MICU) has hit the ground a first time, in which case some sound caused by bouncing of the sound capture device (MICU) could be transmitted to the hearing aid, but with a lower sound level than usual and thereby with less inconvenience to the user.

As not all impact sounds may be annoying to the user, the onset of a free fall could for a first period of time trigger a lowering of the output level, and if the fall continues beyond this first period, the output volume could then be lowered to no output, i.e. a complete mute. This could prevent that all sounds are muted if the device only falls a short distance and the sounds transmitted from the sound capture device are back to normal level faster.

Besides free fall, one could imagine that the sound capture device bounces into something (without a free fall prior to the impact). As there is a small transmission delay, we may as well have a few milliseconds after a high acceleration has been detected (due to the impact) to mute the hearing aid or to stop the transmission of sound from the sound device.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein but are to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[Elko & Pong; 1995] Gary W Elko, Anh-Tho Nguyen Pong, "A Simple Adaptive First-Order Differential Microphone". Published in: Proceedings of 1995 Workshop on Applications of Signal Processing to Audio and Acoustics, IEEE, Print ISBN: 0-7803-3064-1.

EP3588981A1 (Oticon) Jan. 1, 2020.

EP3253075A1 (Oticon) Jun. 12, 2017.

The invention claimed is:

1. A sound capture device configured to be worn by a person and/or to be located on a surface, the sound capture device being configured to pick up target sound from a target sound source s, the sound capture device comprising an input unit comprising a multitude of input transducers $IT_m$, m=1, 2, . . . , M, M being larger than or equal to two, each input transducer being configured to pick up a sound from the environment of the sound capture device and to provide corresponding electric input signals, each electric input signal $IN_m$, m=1, . . . , M, comprising a target signal component and a noise signal component;

a housing wherein said multitude of input transducers are located;

a directional noise reduction system for providing an estimate of the target sound s, the directional noise reduction system comprising a beamformer unit operationally coupled to said multitude of input transducers $IT_m$, m=1, . . . , M, the beamformer unit comprising target maintaining, reference beamformer configured to leave signal components from a fixed target direction un-attenuated or less attenuated relative to signal components from other directions, and providing a current reference signal; and a target cancelling beamformer configured to attenuate signal components from said target direction, whereas signal components from other directions are attenuated less relative to signal components from said target direction, and providing a current target cancelling signal;

the directional noise reduction system being configured to operate in at least two modes in dependence of a mode control signal, a directional mode wherein said estimate of the target sound s is based on target signal components from said fixed target direction, and a non-directional, omni-directional mode, wherein said estimate of the target sound s is based on target signal components from all directions;

antenna and transceiver circuitry for establishing an audio link to another device, and wherein the sound capture device is configured to transmit said estimate of the target sound s to said another device; and a mode controller for determining said mode control signal in dependence of said current reference signal and said current target cancelling signal.

2. A sound capture device according to claim 1, wherein at least one of said input transducers is a microphone.

3. A sound capture device according to claim 1 comprising a filter bank.

4. A sound capture device according to claim 3, wherein the magnitude, or otherwise processed versions, of the respective current reference signal and the current target cancelling signal are averaged across time to provide respective smoothed reference and target-cancelling measures.

5. A sound capture device according to claim 4 comprising a voice activity detector and wherein the sound capture device is configured to provide that the averaging only takes place, in time frames when the user's voice is detected by the voice activity detector.

6. A sound capture device according to claim 3 comprising a combination processor configured to compare said current reference signal and said current target cancelling signal, or processed versions thereof, in different frequency sub-bands, and to provide respective frequency sub-band comparison signals.

7. A sound capture device according to claim 3 comprising a decision controller configured to provide a resulting mode control signal indicative of an appropriate mode of operation of the directional noise reduction system in dependence of said frequency sub-band comparison signals.

8. A sound capture device according to claim 7 wherein said decision controller is configured to provide said resulting mode control signal in dependence of a weighted sum of individual sub-band comparison signals.

9. A sound capture device according to claim 7 wherein said directional noise reduction system is adapted to be in a directional mode when said mode control signal indicates a relatively large difference over frequency between said current reference signal and said current target cancelling signal, or processed versions thereof, and to be in an omni-directional mode when said mode control signal indicates a relatively small difference over frequency between said current reference signal and said current target cancelling signal, or processed versions thereof.

10. A sound capture device according to claim 1 being constituted by or comprising a microphone device.

11. A hearing system comprising a sound capture device according to claim 1 and the another device, wherein said sound capture device and said another device are configured to establish a communication link between them allowing the exchange of data, including audio data between them or from the sound capture device to the another device.

12. A hearing system according to claim 11 wherein the another device is a hearing device.

13. A hearing system according to claim 12 wherein said hearing device is constituted by or comprises an air-conduction type hearing aid, a bone-conduction type hearing aid, a cochlear implant type hearing aid, or a combination thereof.

14. A hearing system according to claim 11 adapted to provide that said sound capture device transmits said estimate of the target sound s to the another device.

15. Use of a sound capture device as claimed in claim 1.

16. A sound capture device according to claim 1 wherein the housing comprises a preferred direction coinciding with said fixed target direction.

17. A method of operating a sound capture device configured to be worn by a person and/or to be located on a surface, the sound capture device being configured to pick up target sound from a target sound source s, the method comprising providing a multitude M of electric input signals, each electric input signal $IN_m$, m=1, . . . , M, comprising a target signal component and a noise signal component;

providing an estimate of the target sound s, providing a target maintaining, reference beamformer configured to attenuate signal components from other directions than a fixed target direction, whereas signal components from the fixed target direction are left un-attenuated or are attenuated less relative to signal components from said other directions, and providing a reference signal in dependence of said multitude M of electric input signals; and providing a target cancelling beamformer configured to attenuate signal components from said target direction, whereas signal components from other directions are attenuated less relative to signal components from said target direction, and providing a target cancelling signal in dependence of said multitude M of electric input signals;

providing at least two modes in dependence of a mode control signal, a directional mode wherein said estimate of the target sound s is based on target signal components from said fixed target direction, and a non-directional, omni-directional mode, wherein said estimate of the target sound s is based on target signal components from all directions;

establishing an audio link to another device, and transmitting said estimate of the target sound s to said another device, determining said mode control signal in dependence of said reference signal and said target cancelling signal.

18. A data processing system comprising a processor and program code means for causing the processor to perform the steps of the method of claim 17.

19. A non-transitory computer readable medium on which is stored a computer program comprising instructions which, when the program is executed by a computer, cause the computer to carry out the method of claim 17.

20. A hearing aid configured to be worn by a user, the hearing aid comprising an input unit comprising a multitude of input transducers $IT_m$, m=1, 2, . . . , M, M being larger than or equal to two, each input transducer being configured to pick up a sound from the environment of the sound capture device and configured to provide corresponding electric input signals, each electric input signal $IN_m$, m=1, . . . , M, comprising a target signal from a target signal source and a noise signal from one or more noise signal sources;

an own voice detector configured to provide an own voice control signal indicative of whether or not, or with what probability, a given electric input signal, or a processed version thereof, originates from the voice of said user; the own voice detector comprising a beamformer unit operationally coupled to said multitude of input transducers $IT_m$, m=1, . . . , M, the beamformer unit comprising target maintaining, reference beamformer configured to leave signal components from a fixed target direction un-attenuated or less attenuated relative to signal components from other directions, and providing a current reference signal; and a target cancelling beamformer configured to attenuate signal components from said target direction, whereas signal components from other directions are attenuated less relative to signal components from said target direction, and providing a current target cancelling signal;

wherein said fixed target direction is a direction from the hearing aid towards the user's mouth and said target signal is the user's own voice; and a controller for determining said own voice control signal in dependence of said current reference signal and said current target cancelling signal.

21. A hearing aid according to claim 20 wherein said controller is configured to determine said own voice control signal in dependence of a comparison of said current reference signal and said current target cancelling signal.

22. A hearing aid according to claim 20 wherein said controller is configured to determine said own voice control signal in dependence of the magnitude of the reference and target cancelling beamformers.

* * * * *